US009263798B1

(12) United States Patent
Piazza et al.

(10) Patent No.: US 9,263,798 B1
(45) Date of Patent: Feb. 16, 2016

(54) RECONFIGURABLE ANTENNA APPARATUS

(71) Applicant: Adant Technologies, Inc., Pleasanton, CA (US)

(72) Inventors: Daniele Piazza, Padua (IT); Francesco Donzelli, Castel Maggiore (IT); Mauro Facco, Santa Giustina in Colle (IT)

(73) Assignee: Adant Technologies, Inc., Pleasanton, CA (US)

( * ) Notice: Subject to any disclaimer, the term of this patent is extended or adjusted under 35 U.S.C. 154(b) by 0 days.

(21) Appl. No.: 14/700,762

(22) Filed: Apr. 30, 2015

(51) Int. Cl.

| | |
|---|---|
| ***H01Q 3/02*** | (2006.01) |
| ***H01Q 3/44*** | (2006.01) |
| ***H01Q 21/30*** | (2006.01) |
| ***H01Q 19/10*** | (2006.01) |
| ***H01Q 15/00*** | (2006.01) |

(52) U.S. Cl.
CPC ..... *H01Q 3/446* (2013.01); *H01Q 15/002* (2013.01); *H01Q 19/10* (2013.01); *H01Q 21/30* (2013.01)

(58) Field of Classification Search
CPC ..... H01Q 3/02; H01Q 3/12; H01Q 3/00; H01Q 21/30; H01Q 19/10; H01Q 15/002
USPC ..... 342/374, 372, 368
See application file for complete search history.

(56) References Cited

U.S. PATENT DOCUMENTS

| | | | | |
|---|---|---|---|---|
| 5,861,844 | A * | 1/1999 | Gilmore et al. | 342/374 |
| 6,606,057 | B2 * | 8/2003 | Chiang et al. | 342/374 |
| 2009/0140946 | A1 | 6/2009 | Ziolkowski et al. | |
| 2012/0098701 | A1 | 4/2012 | Loh et al. | |
| 2013/0293523 | A1 * | 11/2013 | Chan et al. | 345/212 |
| 2014/0313080 | A1 * | 10/2014 | Smith et al. | 342/372 |

OTHER PUBLICATIONS

Huang, W.J. et al., "A high-gain dual-band ESPAR antenna with simple on/off controlling," IEEE 2010, pp. 315-318.

Tarn, I-Young et al., "A Novel Pattern Diversity Reflector Antenna Using Reconfigurable Frequency Selective Reflectors," IEEE Transactions on Antennas and Propagation, vol. 57, No. 10, Oct. 2009, pp. 3035-3042.

Zhang, S. et al. "A Pattern Reconfigurable Microstrip Parasitic Array," IEEE Transactions on Antennas and Propagation, vol. 52, No. 10, Oct. 2004, pp. 2773-2776/.

Lee, M. L. et al., "A Pattern Reconfigurable Strip Monopole with Eight Switched Printed Parasitic Elements," IEEE 2007, pp. 3177-3180.

(Continued)

*Primary Examiner* — Harry Liu
(74) *Attorney, Agent, or Firm* — Yukiko O. Maekawa

(57) ABSTRACT

An antenna apparatus may include a reflective layer connected to a ground, one or more first antennas disposed on the reflective layer, wherein each first antenna includes a first active element and one or more first parasitic elements; one or more first switching devices, each associated with corresponding one of the one or more first parasitic elements in at least one of one or more first antennas, one or more second antennas disposed on the reflective layer, wherein each second antenna includes a second active element and one or more second parasitic elements, and one or more second switching devices, each associated with corresponding one of the one or more second parasitic elements in at least one of one or more second antennas. The first antennas operate at a first frequency. The second antennas operate at a second frequency different from the first frequency.

22 Claims, 21 Drawing Sheets

(56) References Cited

OTHER PUBLICATIONS

Abdalla, Mohamed A. Y. et al., "A Planar Electronically Steerable Patch Array Using Tunable PRI/NRI Phase Shifters," IEEE Transactions on Microwave Theory and Techniques, vol. 57, No. 3, Mar. 2009, pp. 531-541.
Liu, Haitao et al., "Compact-Size Electronically Steerable Parasitic Array Radiator Antenna," 2009 Loughborough Antennas & Propagation Conference, Nov. 16-17, 2009, Loughborough, U.K., pp. 265-268.
Gyoda, Koichi et al., "Design of Electronically Steerable Passive Array Radiator (ESPAR) Antennas," IEEE 2000, pp. 922-925.
Lu, Junwei et al., "Dielectric Embedded ESPAR (DE-ESPAR) Antenna Array for Wireless Communications," IEEE Transactions on Antennas and Propagation, vol. 53, No. 8, Aug. 2005, pp. 2437-2443.
Kawakami, Haruo et al., "Electrically Steerable Passive Array Radiator (ESPAR) Antennas," IEEE Antennas and Propagation Magazine, vol. 47, No. 2, Apr. 2005, pp. 43-49.
Liu, Hai-Tao et al., "Electrically Small and Low Cost Smart Antenna for Wireless Communication," IEEE Transactions on Antennas and Propagation, vol. 60, No. 3, Mar. 2012, pp. 1540-1549.
Lim, Sungjoon et al., "Metamaterial-Based Electronically Controlled Transmission-Line Structure as a Novel Leaky-Wave Antenna With Tunable Radiation Angle and Beamwidth," IEEE Transactions on Microwave Theory and Techniques, vol. 53, No. 1, Jan. 2005, pp. 161-173.
Erentok, Aycan et al., "Metamaterial-Inspired Efficient Electrically Small Antennas," IEEE Transactions on Antennas and Propagation, vol. 56, No. 3, Mar. 2008, pp. 691-707.
Weiner, Melvin M., "Monopole Element at the Center of a Circular Ground Plane Whose Radius is Small or Comparable to a Wavelength," IEEE Transactions on Antennas and Propagation, vol. AP-35, No. 5, May 1987, pp. 488-495.
Harrington, Roger F., "Reactively Controlled Directive Arrays," IEEE Transactions on Antennas and Propagation, vol. AP-26, No. 3, May 1978, pp. 390-395.

* cited by examiner

RECONFIGURABLE ANTENNA APPARATUS

TECHNICAL FIELD

Embodiments disclosed relate generally to antenna apparatuses and systems, more specifically reconfigurable antenna apparatuses and reconfigurable antenna systems.

BACKGROUND

Available spectrum resources for wireless communication systems are limited. However, since improvement on performance of the wireless communication systems is desired, more efficient use of spectrum resources may be required. Since reconfigurable antenna apparatuses/systems may provide various radiation patterns, the reconfigurable antenna apparatuses/systems may address the requirements of more efficient use of spectrum resources and improve the overall performance of the wireless communication systems in which the reconfigurable antenna apparatuses/systems are involved. For reconfigurable antenna apparatuses/systems, higher radiation efficiency has been desired. Also, more compact and less complicated designs have been desired for reconfigurable antenna apparatuses/systems.

SUMMARY

In one aspect, an antenna apparatus may include a reflective layer connected to a ground, one or more first antennas disposed on the reflective layer, wherein each of the one or more first antennas operates at a first frequency, and includes a first active element and one or more first parasitic elements, one or more first switching devices, each associated with corresponding one of the one or more first parasitic elements in at least one of one or more first antennas, one or more second antennas disposed on the reflective layer, wherein each of the one or more second antennas operates at a second frequency, and includes a second active element and one or more second parasitic elements, and one or more second switching devices, each associated with corresponding one of the one or more second parasitic elements in at least one of one or more second antennas. The first frequency may be different from the second frequency.

In one aspect, the first active element may be one of a first dipole-type antenna, a first monopole-type antenna, or first Planar Inverted F Antenna (PIFA). At least one of the one or more first parasitic elements may be of a first monopole-type, a first dipole-type, or first metamaterial-inspired-type. The second active element may be one of a second dipole-type antenna, a second monopole-type antenna, or second PIFA. At least one of the one or more second parasitic elements may be of a second monopole-type, a second dipole-type, or second metamaterial-inspired-type.

In one aspect, at least one of the one or more first switching devices may include a first diode, and the first diodes may be connected to the corresponding one of the one or more first parasitic elements.

In one aspect, the antenna apparatus may further include one or more first inductors. The first diode may be connected, in series, to corresponding one of the one or more first inductors.

In one aspect, the antenna apparatus may further include one or more second inductors. Each of the one or more second inductors may be connected to the corresponding one of the one or more first parasitic elements and the reflective layer.

In one aspect, the antenna apparatus may further include: one or more first capacitors. Each of the one or more capacitors may be connected to the corresponding one of the one or more first parasitic elements via the first switching device and may be connected to the reflective layer.

In one aspect, the first active element may include a metal plate having slits and the metal plate is disposed at an upper part of the first antenna.

In one aspect, at least one of the one or more first parasitic elements may include: a first non-metal plate having a first surface and a second surface opposed to the first surface, and a first metal strip disposed on the first surface.

In one aspect, at least one of the one or more first parasitic elements may further include a second metal strip having a straight shape disposed on the second surface.

In one aspect, the first metal strip may have a meander shape.

In one aspect, the first metal strip may have M first segments in a first direction and N second segments in a second direction, respectively, wherein M is an integer ≥2. One end portion of ith first segment may be connected to one end portion of (i+1)th first segment via ith second segment, and the other end portion of the (i+1)th first segment is connected to one end portion of (i+2)th first segment via the (i+1)th second segment, wherein $1 \leq i < M$.

In one aspect, at least one of the one or more second parasitic elements may include a first metal element and a second metal element.

In one aspect, at least one of the second switching devices may include a second diode. The first metal element may be connected to the second diode. The second metal element may be connected to the second diode.

In one aspect, the antenna apparatus may further include: a third inductor connecting to the first metal element and the reflective layer, and a fourth inductor connecting to the second metal element the reflective layer.

In one aspect, at least one of the one or more second switching devices may include a third diode and fourth diode. A cathode of the third diode may be connected to the fourth diode. The first metal element may be connected to the third diode. The second metal element may be connected to the fourth diode.

In one aspect, the antenna apparatus may further include: a fifth inductor connecting to the first metal element; a sixth inductor connecting to the second metal element; and a seventh inductor connecting to the fourth diode and the reflective layer.

In one aspect, at least one of the one or more second switching devices may include a variable capacitor.

In one aspect, at least one of the one or more second parasitic elements may include a third metal element, a fourth metal element, and a fifth metal element. At least one of the one or more second switching devices may include a first switch and a second switch. The first switch may be connected to the third metal element and the fourth metal element. The second switch may be connected to the fourth metal element to the fifth metal element.

In one aspect, the first switch may be a fifth diode, and the second switch may be a sixth diode.

In one aspect, the antenna apparatus may further include: a driving circuitry configured to convert digital control signals generated by a processor to analog signals, and provide, based on the analog signals, respective direct current (DC) biases to at least one of the one or more first switching devices and the one or more second switching devices via corresponding bias lines.

In one aspect, a distance between a first active element of one of the first antennas and a first active element of a first antenna closest to the one of the first antennas may be equal to or more than $\lambda_1/2$. $\lambda_1$ is a wavelength of the first frequency.

In one aspect, a distance between a second active element of one of the second antennas and a first active element of a second antenna closest to the one of the second antennas may be equal to or more than $\lambda_2/2$. $\lambda_2$ is a wavelength of the second frequency.

In one aspect, the second active element and at least two second parasitic elements among the second parasitic elements may be disposed on a dielectric layer.

BRIEF DESCRIPTION OF THE DRAWINGS

The accompanying drawings, which are incorporated in and constitute a part of this specification, illustrate one or more embodiments described herein and, together with the description, explain the embodiments. In the drawings.

DETAILED DESCRIPTION

The following detailed description refers to the accompanying drawings. The same reference numbers in different drawings may identify the same or similar elements.

Figure 1:
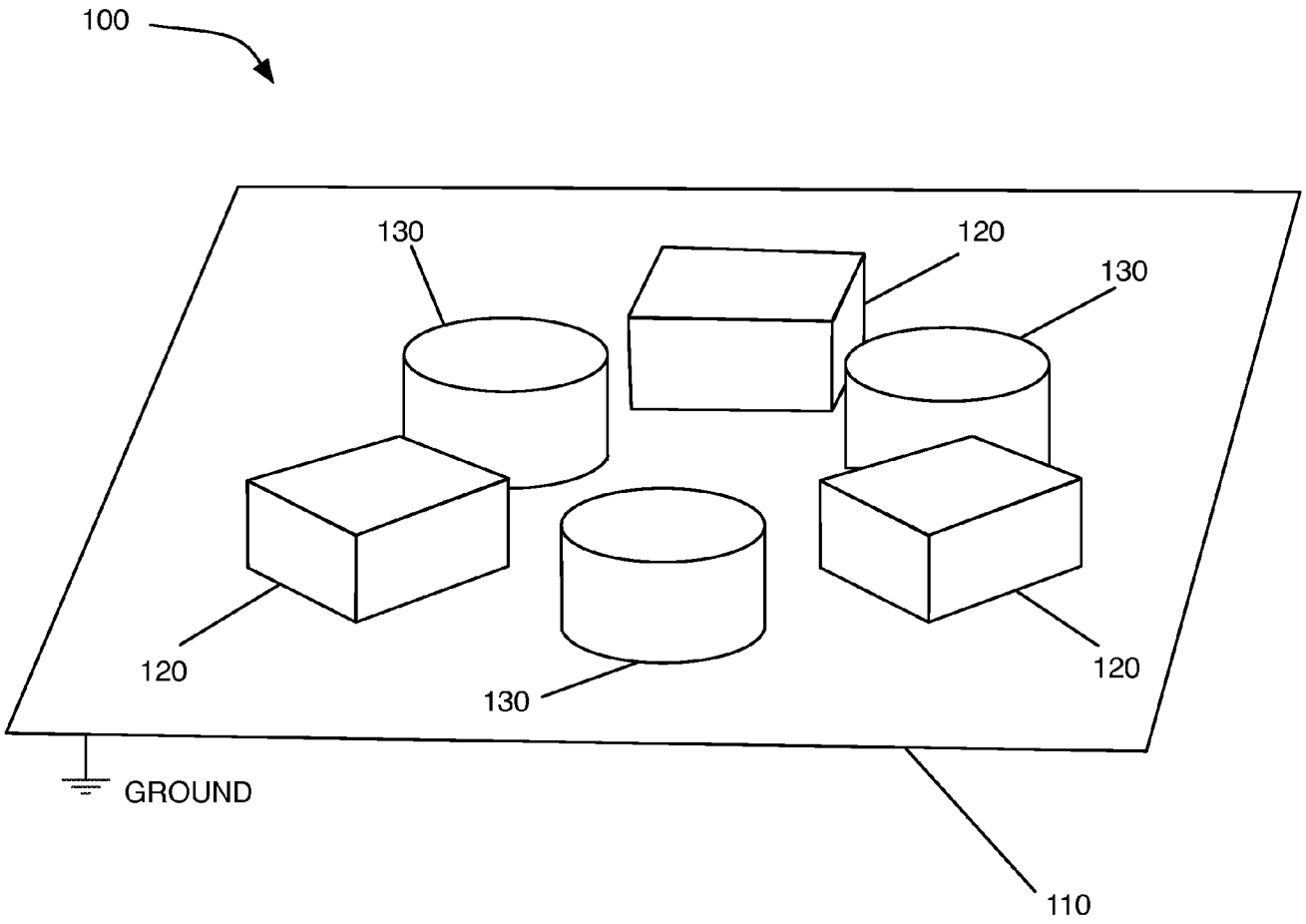
FIG. 1 is a schematic diagram of an exemplary antenna apparatus.

FIG. 1 is a schematic diagram of an exemplary antenna apparatus. Antenna apparatus 100 may include reflective layer 110, one or more first antennas 120, and one or more second antennas 130. Antenna configuration of one or more first antennas 120 may be different from antenna configuration of one or more second antennas 130.

In FIG. 1, three first antennas 120 and three second antennas 130 are disposed on reflective layer 110. However, the number of one or more first antennas 120 may be any integer equal to or more than one. Also, the number of one or more second antennas 130 may be any integer equal to or more than one. The number of one or more first antennas 120 may be the same as or different from the number of one or more second antennas 130. One or more first antennas 120 may operate at a first frequency. One or more second antennas 130 may operate at a second frequency. The first frequency may be different from the second frequency.

One or more first antennas 120 may be disposed on reflective layer 110. One or more second antennas 130 may be disposed on reflective layer 110. One or more first antennas 120 and one or more second antennas 130 may be disposed on the same surface of reflective layer 110. Reflective layer 110 may be a printed circuit board (PCB). Reflective layer 110 may be a dual layer PCB. The PCB and the dual layer PCB may include dielectric material. Reflective layer 110 may connect to the ground, and may act as a ground plate electrically. First antennas 120 and second antennas 130 may be disposed alternately, surrounding the center of reflective layer 110.

Figure 2:
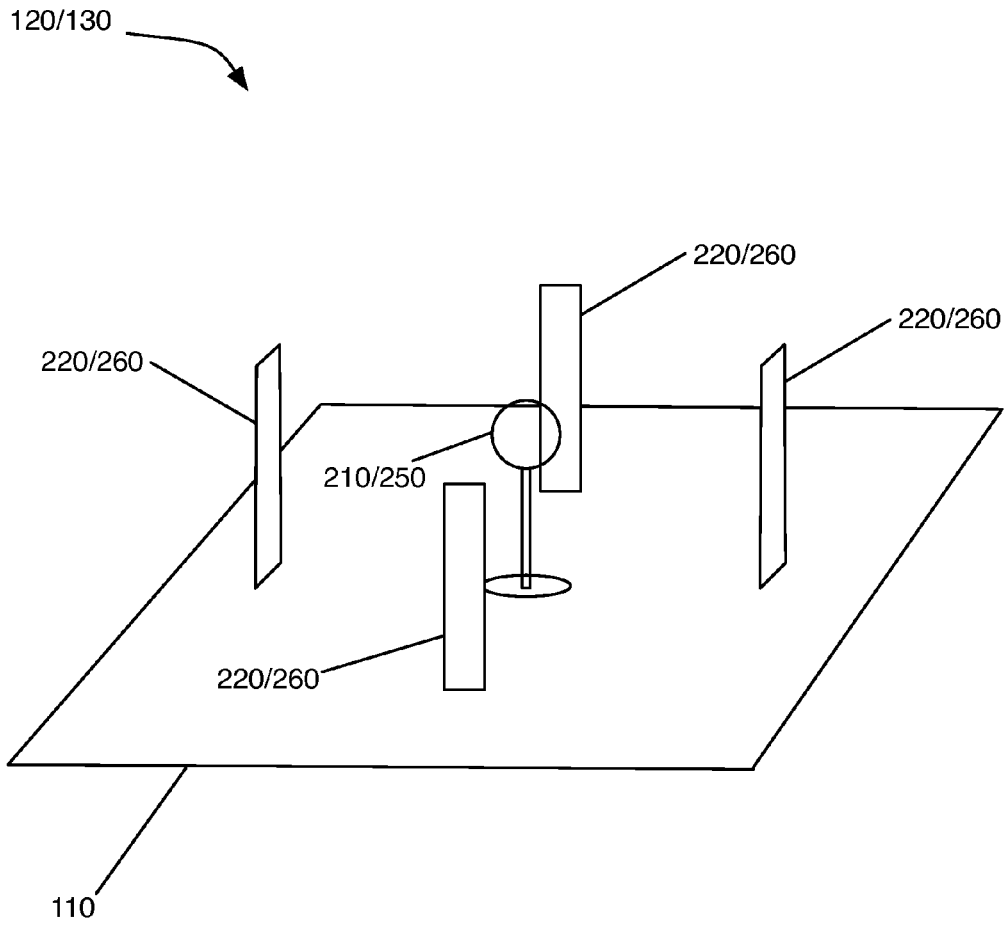
FIG. 2 is a schematic diagram illustrating an exemplary configuration of first antenna and second antenna.

FIG. 2 is a schematic diagram illustrating an exemplary configuration of the first antenna and second antenna in FIG. 1.

Each of one or more first antennas 120 may include first active element 210 and one or more first parasitic elements 220. First active element 210 may be connected to a receiving device and/or a transmitting device. When first active element 210 receives a current signal from the transmitting device, first active element 210 may generate and transmit electromagnetic radiation to a surrounding space at the first frequency. When first active element 210 receives electromagnetic radiation from the surrounding space at the first frequency, first active element 210 may transmit a current signal generated in first active element 210 to the receiving device. The electromagnetic radiation pattern of first active element 210 may be an omni-directional. Other radiation patterns may be possible.

Each of one or more first parasitic elements 220 may not be connected directly to the receiving device and/or transmitting device, and may be considered a passive radiator. Each of one or more first parasitic elements 220 may operate as a reflector or a director. When first parasitic element 220 acts as a reflector, first parasitic element 220 may reflect at least a part of the electromagnetic radiation received and/or transmitted by first active element 210. When first parasitic element 220 acts as a director, first parasitic element 220 may direct at least a part of the electromagnetic radiation received and/or transmitted by first active element 210.

At least one of one ore more first active elements 210 in at least one of one or more first antennas 120 may be a first monopole-type antenna, a first dipole-type antenna, or a first PIFA.

At least one of one or more first parasitic elements 220 in at least one of one or more first antennas 120 may be a first monopole-type, a first dipole-type, or a first metamaterial-inspired-type.

Each of one or more second antennas 130 may include second active element 250 and one or more second parasitic elements 260. Second active element 250 may be connected to a receiving device and/or a transmitting device. When second active element 250 receives a current signal from the transmitting device, second active element 250 may generate and transmit electromagnetic radiation to a surrounding space at the second frequency. When, second active element 250 may receive electromagnetic radiation from the surrounding space at the second frequency, second active element 250 may transmit a current signal generated in second active element 250 to the receiving device. The electromagnetic radiation pattern of second active element 250 may be an omni-directional. Other radiation patterns may be possible.

Each of one or more second parasitic elements 260 may not be connected directly to the receiving device and/or transmitting device, and may be considered a passive radiator. Each of one or more second parasitic elements 260 may operate as a reflector or a director. When second parasitic element 260 acts as a reflector, second parasitic element 260 may reflect at least a part of the electromagnetic radiation received and/or transmitted by second active element 250. When second parasitic element 260 acts as a director, second parasitic element 260 may direct at least a part of the electromagnetic radiation received and/or transmitted by second active element 250.

At least one of one ore more second active elements 250 in at least one of one or more second antennas 130 may be a second monopole-type antenna, a second dipole-type antenna, or a second PIFA.

At least one of one or more second parasitic elements 260 in at least one of one or more second antennas 130 may be a second monopole-type, a second dipole-type, or a second metamaterial-inspired-type.

By using the first/second monopole-type antenna, the first/second dipole-type antenna, or the first/second PIFA as first active element 210 and/or second active element 250, antenna apparatus 100 may have high efficiency and a small size. When first active element 210 and/or second active element 250 may have high radiation resistance, the radiation efficiencies of first antenna 120 and/or second antenna 130 may be high.

For example, a λ/2 dipole-type radiator/antenna may be used as first active element 210 and/or second active element 250 to obtain the high radiation resistance. The λ/2 dipole-type radiator/antenna may have an electrical length equal to λ/2 where λ is the wavelength of the frequency at which the λ/2 dipole-type radiator/antenna operates. When an active element is the λ/2 dipole-type radiator/antenna, approximately all the excited currents on a metal structure of the λ/2 dipole-type radiator/antenna may contribute to the radiation of the active element, while minimizing the ohmic losses on the active element. For example, the λ/2 dipole-type radiator/antenna may be used as an active element for an antenna operating at 5 GHz.

On the other hand, a λ/4 monopole-type radiator/antenna or a PIFA may be used as an active element for an antenna operating at frequencies lower than 5 GHz. The λ/4 monopole-type radiator/antenna may act as a virtual dipole, and may have an electrical length equal to λ/4 where λ is the wavelength of the frequency at which the λ/4 dipole-type radiator/antenna operates. The λ/4 monopole-type radiator/antenna may exploit the image theory, using a reflective layer connecting the ground. The reflective layer which acts the ground may act as a mirror for currents flowing through the antenna. Consequently, λ/4 monopole-type radiator/antenna may present a behavior of a virtual dipole. The λ/4 monopole-type radiator/antenna may have good radiation efficiency if reflective layer connecting the ground, i.e., a ground plane is extended.

When the electrical length of the monopole-type radiator/antenna is lower than λ/4, reactance of the monopole-type radiator/antenna may increase, and the self-resonance frequency of the monopole-type radiator/antenna may be higher. The above-described effect may be avoided when an active element has a structure to have a good impedance matching at the electromagnetic radiation power feeding point. Also, power losses may be avoided in a frequency band in which the active element having such a structure operates.

Figure 15:
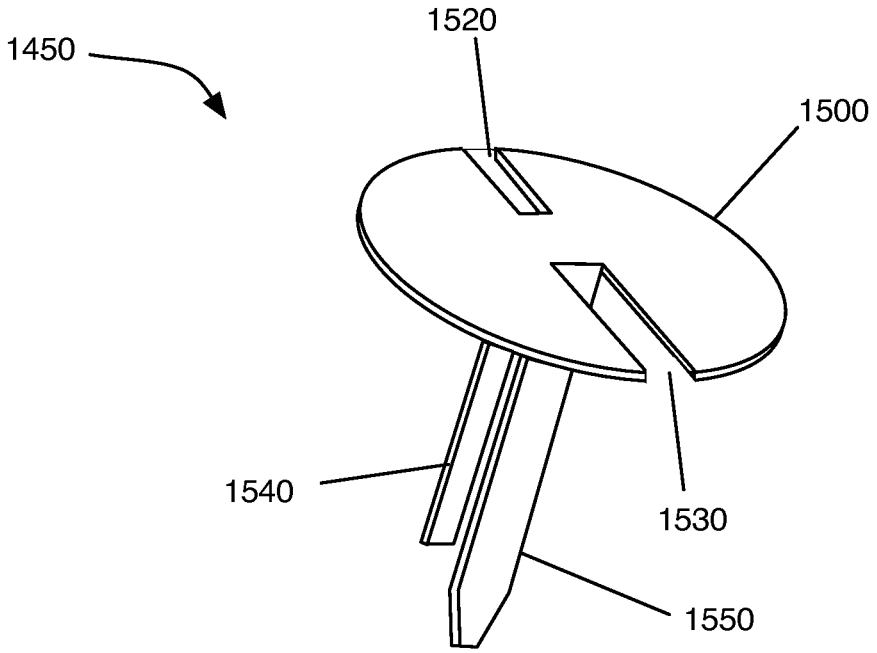
FIG. 15 is a perspective view of an exemplary first active element of the first antenna illustrated in FIG. 14.
Figure 16:
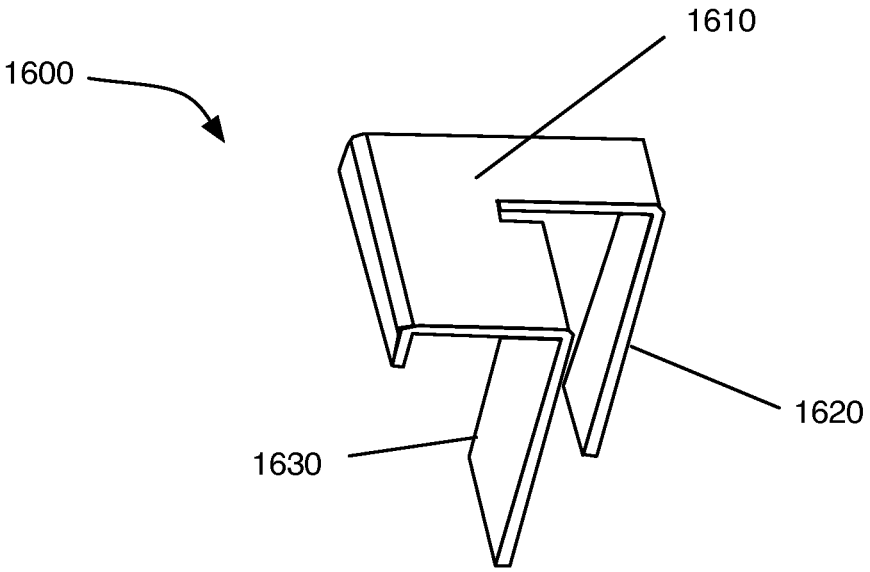
FIG. 16 is a perspective view of another exemplary first active element of the first antenna illustrated in FIG. 14.

For example, when a monopole-type active element is top-loaded and/or have an arm shorting to the ground as illustrated in FIGS. 15 and 16, a good impedance matching at the electromagnetic radiation power feeding point may be obtained, and/or power loss may be avoided in a frequency band in which the monopole-type active element active element operates.

Antenna apparatus 100 may include one or more first switching devices (not shown in FIG. 2). Each of one or more first switching devices may be associated with a corresponding one of one or more first parasitic elements 220 in at least one of one or more first antennas 120. Antenna apparatus 100 may include one or more second switching devices (not shown in FIG. 2). Each of one or more second switching devices may be associated with a corresponding one of one or more second parasitic elements 260 in at least one of one or more second antennas 130.

A radiation pattern of each first antenna 120 may be changed by controlling a state of each first switching device associated with the corresponding one of one or more first parasitic elements 220. A radiation pattern of each second antenna 130 may be changed by controlling a state of each second switching device associated with the corresponding one of one or more second parasitic elements 260.

When an antenna (e.g. antenna 120/130) includes a parasitic element (e.g. parasitic element 220/260) in addition to an active antenna (e.g. active element 210/250), a far-field may be generated by a surface current induced on the parasitic element by setting an electrical length of the parasitic element to a specific electrical length and/or setting a distance between the parasitic element and the active element to a specific value. The generated far-field may be combined with a radio frequency (RF) field radiated by the active element. For example, a pattern of the RF field radiated by the active element may be omni-directional. However, a pattern of the RF field radiated by the active element combines with the far-field, and may form a directional beam. When an antenna includes a plurality of parasitic elements in addition to the active antenna, multiple directional radiation patterns may be formed by controlling an electrical length of each parasitic element.

Figure 3A:
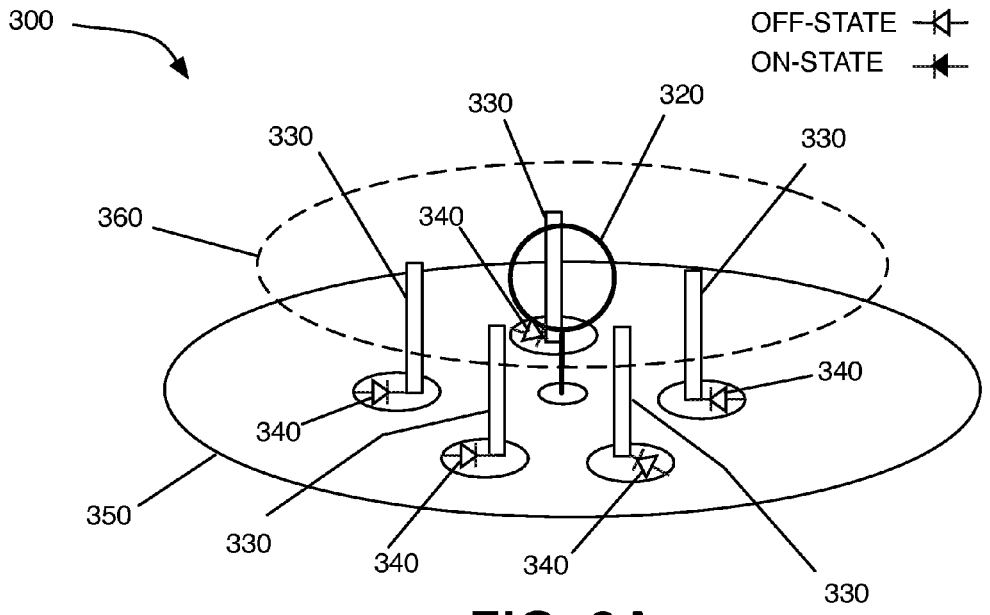
FIG. 3A is a schematic diagram illustrating an omni-directional mode of an antenna including an active element and parasitic elements.
Figure 3B:
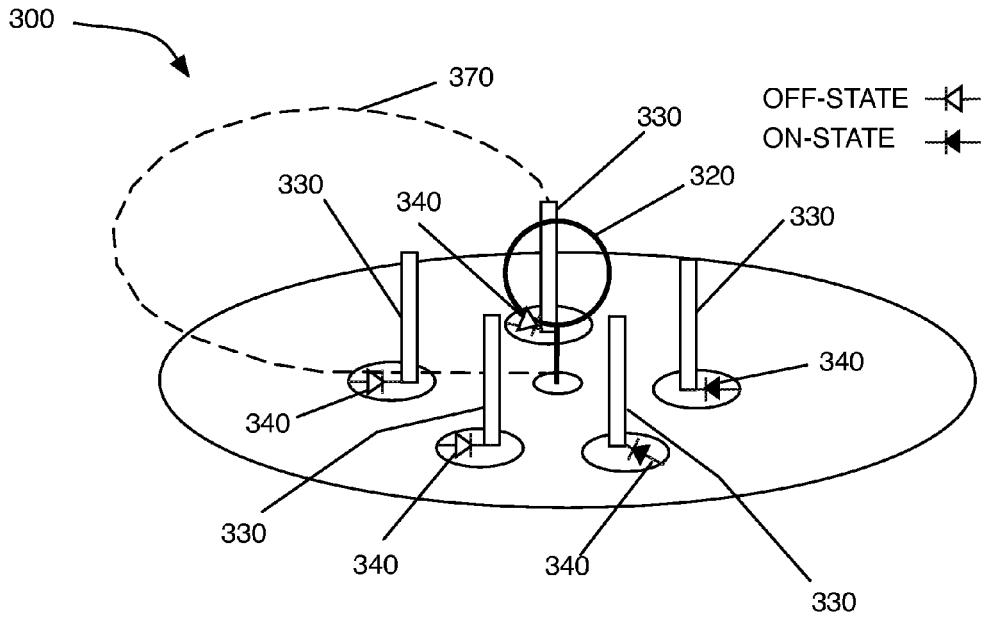
FIG. 3B is a schematic diagram illustrating a directional mode of the antenna including the active element and the parasitic elements.

FIG. 3A is a schematic diagram illustrating an omni-directional mode of an antenna including an active element and parasitic elements. FIG. 3B is a schematic diagram illustrating a directional mode of the antenna including the active element and the parasitic elements. Here, antenna 300 may include active element 320 and five parasitic elements 330. Active element 320 is surrounded by five parasitic elements 330. The number of parasitic elements 330 may be an integer equal to or more than one.

Antenna 300 may include one or more switching devices 340. Each parasitic element 330 may be connected to corresponding one of switching devices 340.

As illustrated in FIG. 3A, when all of the switching devices 340 are in off-state, radiation pattern 360 of antenna 300 may be the same as the radiation pattern of active element 320 itself, and may be omni-directional. This mode may be called an omni-directional mode.

On the other hand, when one switching device 340 is in on-state, a far-field may be generated by a current induced on the surface of parasitic element 330 connected to the switching device 340 in on-state. In this case, parasitic element 330 connected to switching device 340 in on-state may act as a reflector or a director.

As illustrated in FIG. 3B, when some of switching devices 340 are in on-state, far-fields generated on parasitic elements 330 connected to switching devices 340 in on-state may combine with the radiation pattern of active element 320. Consequently, radiation pattern 370 of antenna 300 may be directional. This mode may be called a directional mode.

Each of one or more first antennas 120 and each of one or more second antennas 130 may operate in an omni-directional mode or a directional mode by controlling a state of each first switching device and each second switching devices.

Interference between first antennas 120 may be minimized by setting a distance between first antennas 120. Also, interference between second antennas 130 may be minimized by setting a distance between second antennas 130 to another specific distance.

For example, defining the first distance to be a distance between a center of the first active element in one of first antennas 120 and a center of the first active element in another first antenna 120 closest to the one of first antennas 120, the first distance may be set at least $\lambda_1/2$, where $\lambda_1$ is a wavelength of the first frequency.

Defining the second distance to be a distance between a center of the second active element in one of second antennas 130 and a center of the second active element in another first antenna 130 closest to the one of second antennas 130, the second distance between one of second antennas 130 and another second antenna 130 closest to the one of first antennas 130 may be set at least $\lambda_2/2$, where $\lambda_2$ is a wavelength of the second frequency.

When the first frequency is lower than the second frequency, one or more metamaterial-inspired element may be implemented as one or more first parasitic elements 220 associated with the first active element 210.

Metamaterial inspired element may artificially provide some electromagnetic characteristics which are not available in nature. For example, first parasitic element 220 may be provided as metamaterial inspired element when one or more first parasitic elements 220 have a certain inductive structure placed in the near-filed region of a monopole-type active element.

Alternatively, a short monopole-type parasitic element associated with near-field parasitic cylindrical inductors may be implemented as one or more first parasitic elements 220 associated with first active element 210.

Also, the number of one or more first parasitic elements and/or the number of one or more second parasitic elements may be minimized.

Figure 4:
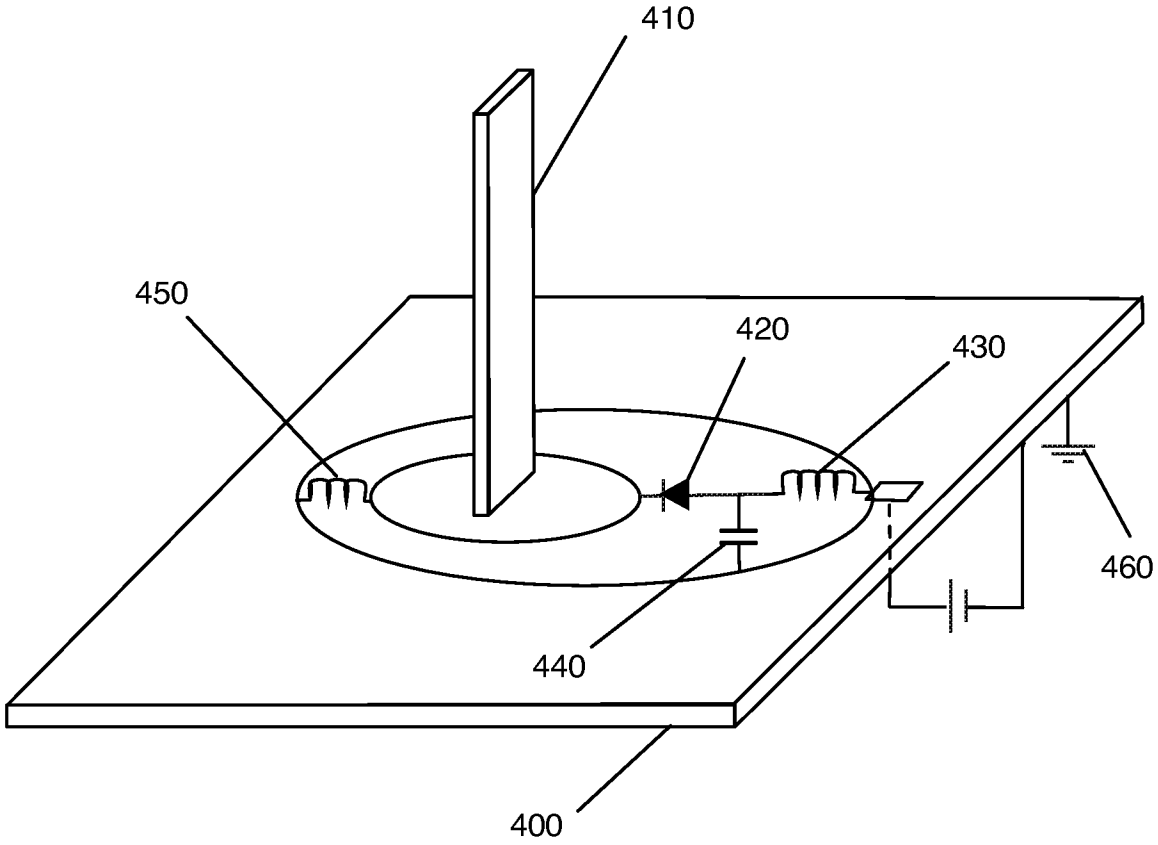
FIG. 4 is a schematic diagram illustrating an exemplary configuration of a monopole-type parasitic element and a switching device.

FIG. 4 is a schematic diagram illustrating an exemplary configuration of a monopole-type parasitic element and a switching device. Switching device 420 may be connected to monopole-type parasitic element 410. Switching device 420 may include a first diode. First diode may be a pin diode. A cathode of first diode 420 may be connected to monopole-type parasitic element 410. First inductor 430 may be provided between switching device 420 and reflective layer 400. For example, an anode of first diode 420 may be connected to first inductor 430 in series. Alternatively, the anode of first diode 420 may be connected to monopole-type parasitic element 410 and the cathode of first diode 420 may be connected to first inductor 430. A metal plate may connect first diode 420 and first inductor 430. Second inductor 450 may be connected to switching device 420 and reflective layer 400. Since reflective layer 400 may be connected to the ground 460, second inductor 450 may provide the ground to switching device 420 while blocking any RF current flow to the ground 460 when switching device 420 is in off-state. When switching device 420 is in on-state, switching device 420 may create a short circuit between monopole-type parasitic element 410 and reflective layer 400. Consequently, monopole-type parasitic element 410 may have an electrical length as a virtual dipole according to the image theory. First capacitor 440 may be connected to parasitic element 410 via switching device 420, and may be connected to the reflective layer 400. Since reflective layer 400 may be connected to the ground 460, first capacitor 440 may discharge, to the ground 460, a current at a high frequency flowing from monopole-type parasitic element 410 through switching device 420 in on-state. Also, first capacitor 440 may prevent pin polarization to alter the ground plane to a null potential.

Figure 5:
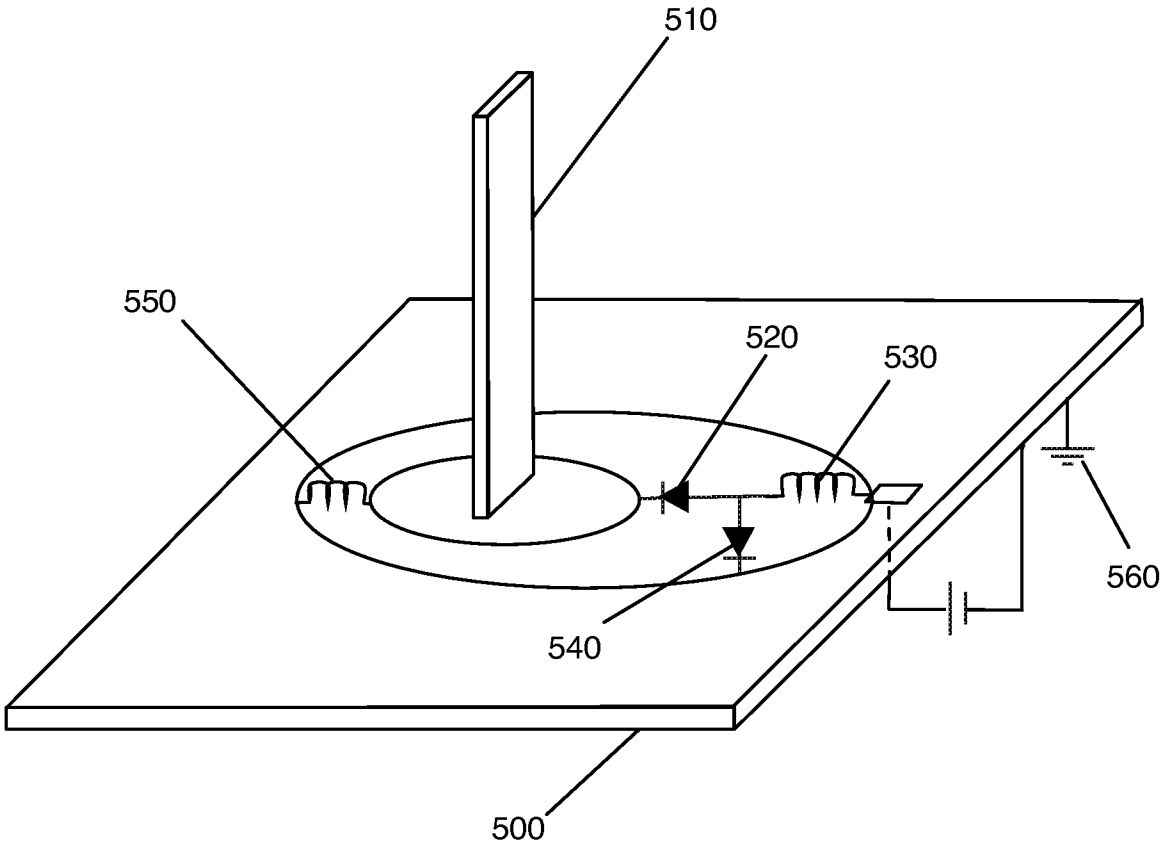
FIG. 5 is a schematic diagram illustrating another exemplary configuration of a monopole-type parasitic element and a switching device.

FIG. 5 is a schematic diagram illustrating another exemplary configuration of a monopole-type parasitic element and a switching device. Switching device 520 may be connected to monopole-type parasitic element 510. Switching device 520 may include a first diode. First diode may be a pin diode. A cathode of first diode 520 may be connected to monopole-type parasitic element 510. First inductor 530 may be provided between switching device 520 and reflective layer 500. For example, an anode of first diode 520 may be connected to first inductor 530 in series. Alternatively, the anode of first diode 520 may be connected to monopole-type parasitic element 510 and the cathode of first diode 520 may be connected to first inductor 530. A metal plate may connect first diode 520 and first inductor 530. A metal plate may connect first diode 520 and first inductor 530. Second inductor 550 may be connected to monopole-type parasitic element 510 and reflective layer 500. Since reflective layer 500 may be connected to the ground 560, second inductor 550 may provide the ground to switching device 520 while blocking any RF current flow to the ground 560 when switching device 520 is in off-state. When switching device 520 is in on-state, switching device 520 may create a short circuit between monopole-type parasitic element 510 and reflective layer 500. Consequently, monopole-type parasitic element 510 may have an electrical length as a virtual dipole according to the image theory. Second diode 540 may be connected to monopole-type parasitic elements 510 via switching device 520, and may be connected to the reflective layer 500. Also, second diode 540 may prevent pin polarization to alter the ground plane to a null potential.

Figure 6:
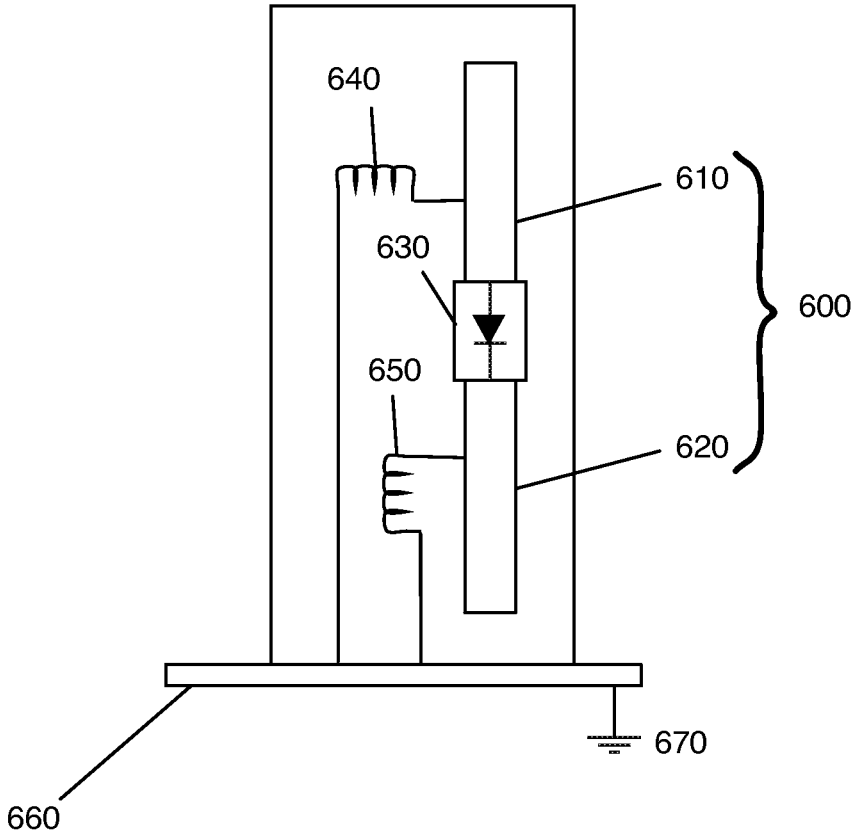
FIG. 6 is a schematic diagram illustrating an exemplary configuration of a dipole-type parasitic element and a switching device.

FIG. 6 is a schematic diagram illustrating an exemplary configuration of a dipole-type parasitic element and a switching device. Dipole-type parasitic element 600 may include first metal element 610 and second metal element 620. Switching device 630 may be connected to first metal element 610 and second metal element 620. Switching device 630 may include a third diode. First metal element 610 may be connected to an anode of third diode 630, and second metal element 620 may be connected to a cathode of third diode 630. Alternatively, first metal element 610 may be connected to the cathode of third diode 630, and second metal element 620 may be connected to the anode of third diode 630. Third inductor 640 may connect to first metal element 610 and reflective layer 660. Fourth inductor 650 may connect to second metal element 620 and reflective layer 660. Reflective layer 660 may be connected to ground 670. An electrical length of dipole-type parasitic element 600 when switching device 630 is in off-state, may be shorter than an electrical length of dipole-type element 600 when the switching device 630 is on-state.

Figure 7:
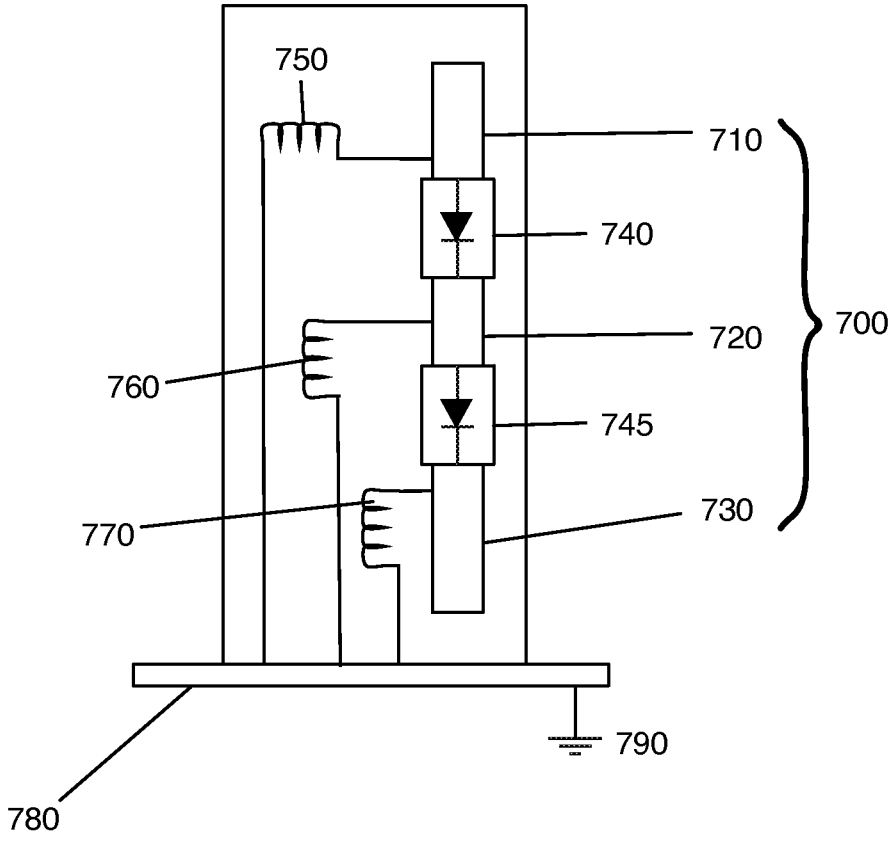
FIG. 7 is a schematic diagram illustrating another exemplary configuration of a dipole-type parasitic element and a switching device.

FIG. 7 is a schematic diagram illustrating another exemplary configuration of a dipole-type parasitic element and switching devices. Dipole-type parasitic element 700 may include third metal element 710, fourth metal element 720, and fifth metal element 730. Switching device-A 740 may be connected to third metal element 710 and fourth metal element 720. Switching device-B 745 may be connected to fourth metal element 720 and fifth metal element 730. Switching device-A 740 may include a sixth diode, and switching device-B 745 may include a seventh diode. An anode of sixth diode 740 may be connected to third metal element 710, a cathode of sixth diode 740 may be connected to fourth metal element 720, an anode of seventh diode 745 may be connected to fourth metal element 720, and a cathode of seventh diode 745 may be connected to fifth metal element 730. Alternatively, the cathode of sixth diode 740 may be connected to third metal element 710, the anode of sixth diode 740 may be connected to fourth metal element 720, the cathode of seventh diode 745 may be connected to fourth metal element 720, and the anode of seventh diode 745 may be connected to fifth metal element 730. Fifth inductor 750 may connect to third metal element 710 and reflective layer 780. Sixth inductor 760 may connect to fourth metal element 720 and reflective layer 780. Seventh inductor 770 may connect to fifth metal element 730 and reflective layer 780. Reflective layer 780 may be connected to ground 790. An electrical length of dipole-type parasitic element 700 when switching device-A 740 and switching device-B 745 are in off-state may be shorter than an electrical length of dipole-type element 700 when switching device-A 740 is in off-state and switching device-B 745 are in on-state. The electrical length of dipole-type element 700 when switching device-A 740 is in off-state and switching device-B 745 are in on-state may be shorter than an electrical length of dipole-type parasitic element 700 when switching device-A 740 and switching device-B 745 are in on-state.

In FIG. 7, dipole-type parasitic element 700 is associated with two switching devices. However, dipole-type parasitic element 700 may be associated with more than two switching devices. That is, dipole-type parasitic element 700 may include K metal elements, and may be associated with K−1 switching devices, wherein K≥2. kth metal element, kth switching device, and (k+1)th metal element may be connected in series, where 1≤k≤K−1. By controlling the state of each of K−1 switching devices, dipole-type parasitic element 700 may be tuned to act as a reflector or a director, or act as if dipole-type parasitic element 700 does not exist.

Figure 8:
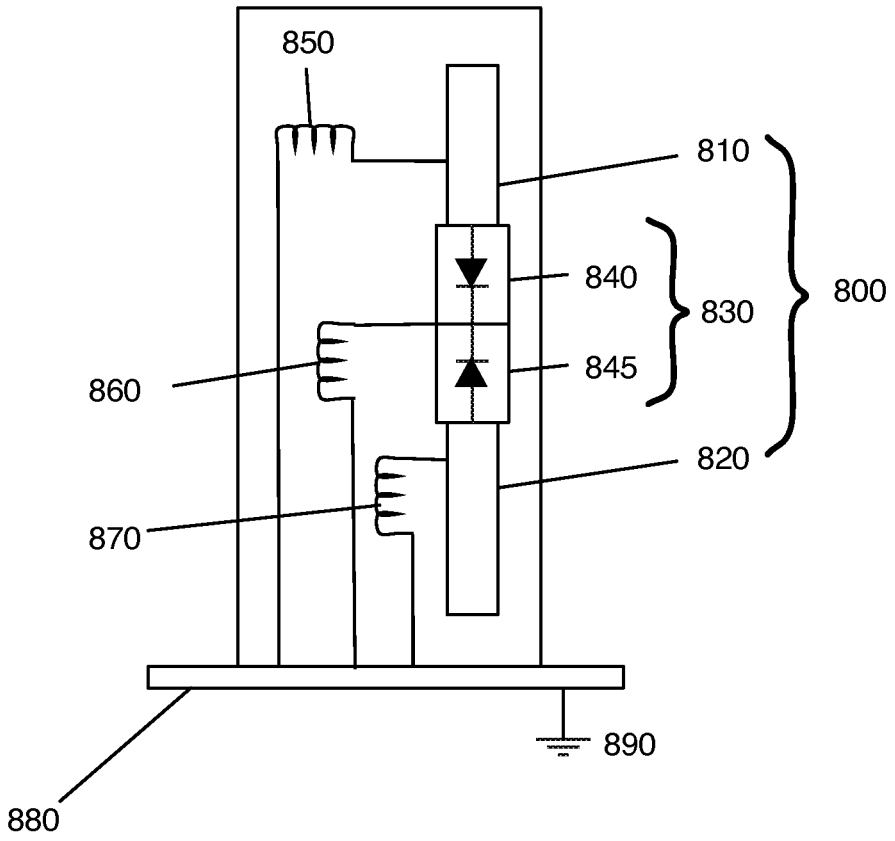
FIG. 8 is a schematic diagram illustrating another exemplary configuration of a dipole-type parasitic element and a switching device.

FIG. 8 is a schematic diagram illustrating another exemplary configuration of a dipole-type parasitic element and a switching device. Dipole-type parasitic element 800 may include first metal element 810 and second metal element 820. Switching device 830 may be connected to first metal element 810 and second metal element 820. Switching devices 830 may include fourth diode 840 and fifth diode 845. A cathode of fourth diode 840 may be connected to a cathode of fifth diode 845. First metal element 810 may be connected to an anode of fourth diode 840. Second metal element 820 may be connected to an anode of fifth diode 845. Eighth inductor 850 may connect to first metal element 810 and reflective layer 880. Ninth inductor 860 may connect to the second metal element 820 and reflective layer 880. Tenth inductor 870 may connect the cathode of fourth diode 840 and reflective layer 880. Reflective layer 880 may be connected to ground 890.

Figure 9:
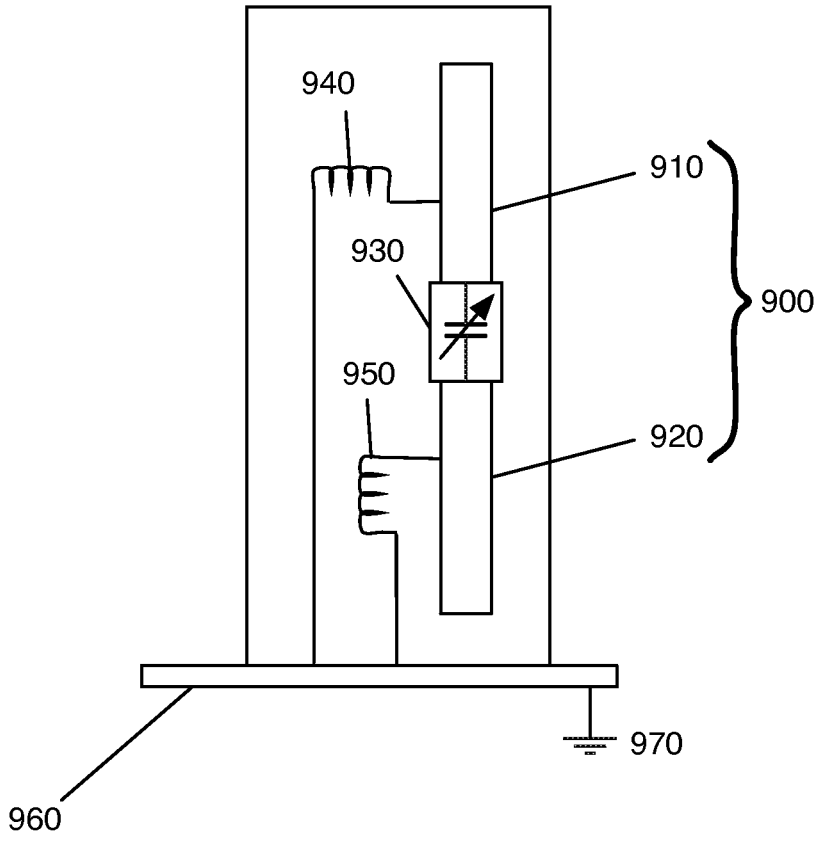
FIG. 9 is a schematic diagram illustrating another exemplary configuration of a dipole-type parasitic element and a switching device.

FIG. 9 is a schematic diagram illustrating another exemplary configuration of a dipole-type parasitic element and a switching device. Dipole-type parasitic element 900 may include first metal element 910 and second metal element 920. Switching device 930 may be connected to first metal element 910 and second metal element 920. Switching device 930 may include a first variable capacitor. First variable capacitor 930 may connect to first metal element 910 and second metal element 920. Eleventh inductor 940 may connect to first metal element 910 and reflective layer 960. Twelfth inductor 950 may connect to the second metal element 920 and reflective layer 760. Reflective layer 960 may be connected to the ground 970.

The electrical length of dipole-type parasitic element 900 may be changed according to a capacitance value of first variable capacitor 930. When capacitance of first variable capacitor 930 is sufficiently large to cut an electrical connection between first metal element 910 and second metal element 920, an electrical length of dipole-type parasitic element 900 may be shorter than an electrical length of dipole-type element 900.

Figures 10A, 10B, 10C:
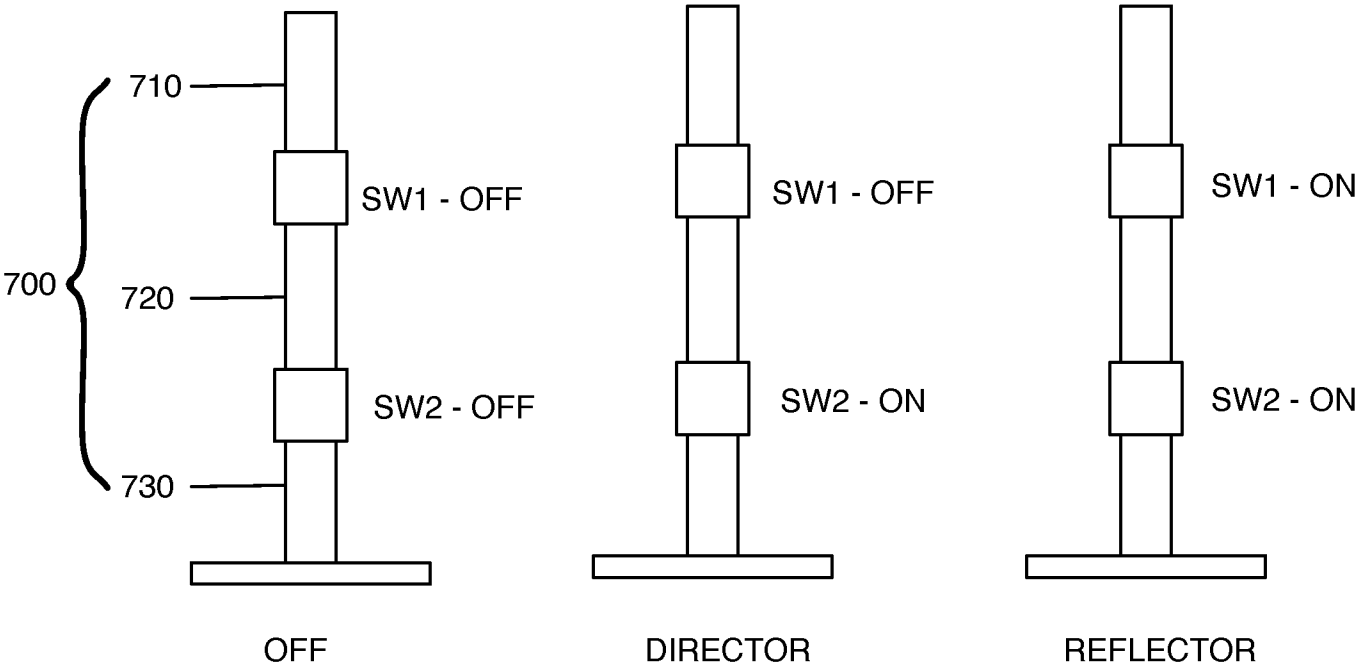
FIGS. 10A-C are schematic diagrams illustrating implementation of a dipole-type parasitic element associated with two switches.

FIGS. 10A-C are schematic diagrams illustrating implementation of a dipole-type parasitic element associated with two switches. First switch SW1 may correspond to switching device-A 740 in FIG. 7. Second switch SW2 may correspond to switching device-B 745 in FIG. 7. When the electrical length of dipole-type parasitic element 700 is longer than $\lambda/2$ where $\lambda$ is the frequency at which the active element associated with dipole-type parasitic element 700 operates, dipole-type parasitic element 700 may act as a reflector. When the electrical length of dipole-type parasitic element 700 is shorter than $\lambda/2$, dipole-type parasitic element 700 may act as a director.

An electrical length of dipole-type parasitic element 700 when first switch SW1 and second switch SW2 are in off-state may be shorter than an electrical length of dipole-type element 700 when first switch SW1 is in off-state and second switch SW2 are in on-state.

The electrical length of dipole-type element 700 when first switch SW1 is in off-state and second switch SW2 are in on-state may be shorter than an electrical length of dipole-type parasitic element 700 when first switch SW1 and second switch SW2 are in on-state.

As illustrated in FIG. 10A, when both of first switch SW1 and second switch SW2 are in off-state, dipole-type parasitic element 700 may not act as either a director or a reflector. As illustrated in FIG. 10B, when first switch SW1 is in off-state and second switch SW2 is in on-state, dipole-type parasitic element 700 may act as a director. As illustrated in FIG. 10C, when both of first switch SW1 and second switch SW2 are in on-state, dipole-type parasitic element 700 may act as a reflector.

Figure 11C:
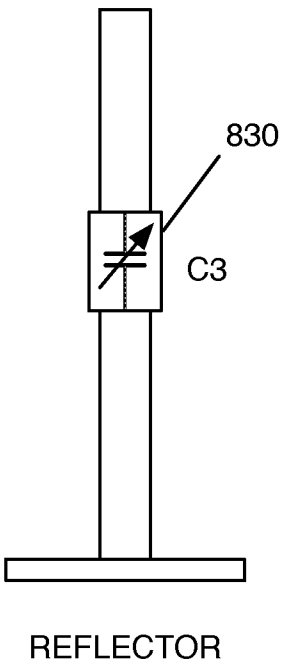
FIGS. 11A-C are schematic diagrams illustrating implementation of a dipole-type parasitic element associated with a variable capacitor illustrated in FIG. 9.
Figure 11B:
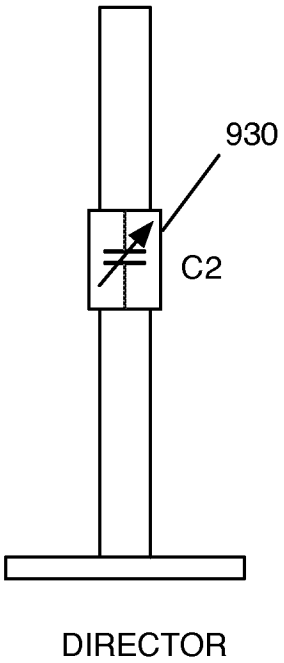
Figure 11A:
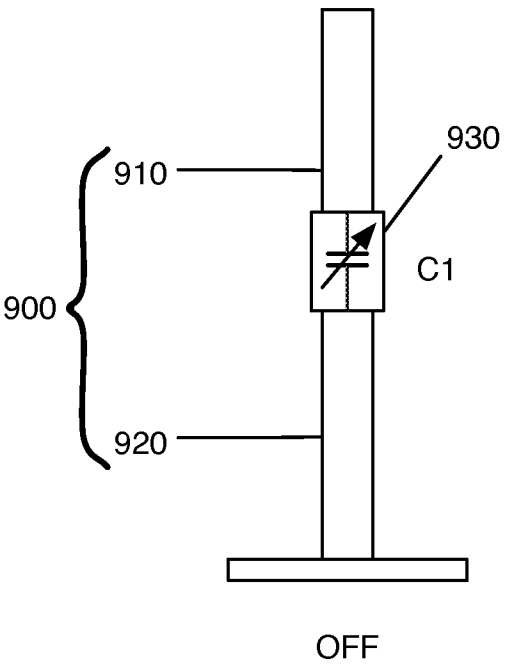

FIGS. 11A-C are schematic diagrams illustrating implementation of a dipole-type parasitic element associated with a variable capacitor illustrated in FIG. 9. The electrical length of dipole-type parasitic element 900 may be varied by varying capacitance of variable capacitor 930. That is, dipole-type parasitic element 900 may be tuned to act as a reflector or a director by varying capacitance of variable capacitor 930.

As illustrated in FIG. 11A, when capacitance of variable capacitor 930 is C1, dipole-type parasitic element 900 may not act as either a director or a reflector. As illustrated in FIG. 11B, when capacitance of variable capacitor 930 is C2, dipole-type parasitic element 900 may act as a director. As illustrated in FIG. 10C, capacitance of variable capacitor 930 is C3, dipole-type parasitic element 900 may act as a reflector.

FIGS. 12A-D are schematic diagrams illustrating various directions of radiation caused by an active element and two parasitic elements. The radiation pattern of an antenna including an active element and parasitic elements may be varied by controlling acts of the parasitic elements. The parasitic elements may be controlled to act as a reflector, a director, or none of the reflector and the director by controlling the switching device(s) as described above. Here, two parasitic elements 1220-1, 1220-2 are disposed along a line on which active element 1210 is not located.

Figure 12B:
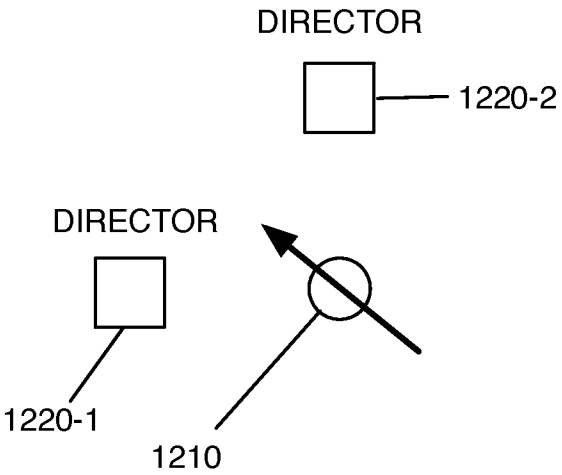
FIGS. 12A-D are schematic diagrams illustrating various directions of radiation caused by an active element and two parasitic elements.
Figure 12A:
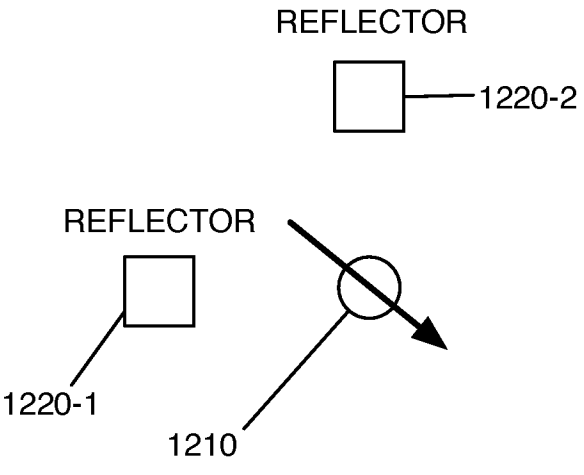
Figure 12D:
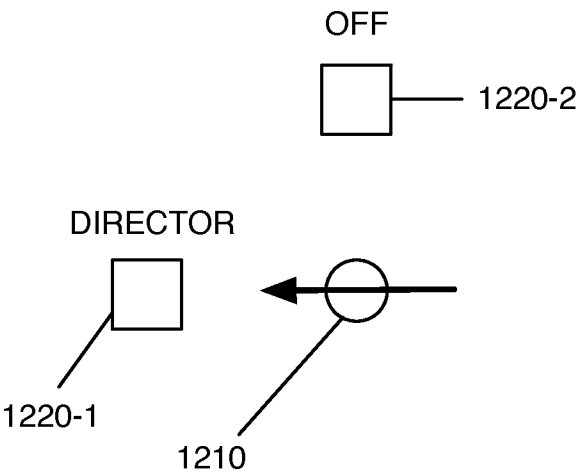
Figure 12C:
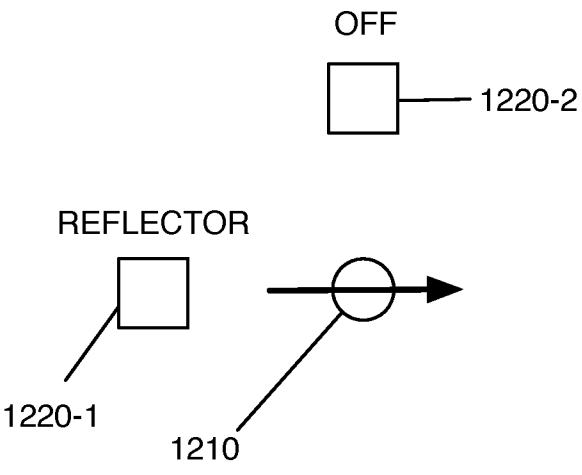

When all of the two parasitic elements 1220-1, 1220-2 are in off-state, the direction of radiation of antenna may be omni-directional. When the two parasitic elements 1220-1, 1220-2 act as a reflector, the direction of radiation of antenna may be indicated by the arrow as illustrated in FIG. 12A. When two parasitic elements 1220-1, 1220-2 act as a director, the direction of radiation of antenna may be indicated by the arrow as illustrated in FIG. 12B. When parasitic element 1220-1 acts as a reflector and parasitic element 1220-2 is in off-state, the direction of radiation of antenna may be indicated by the arrow as illustrated in FIG. 12C. When parasitic element 1220-1 acts as a director and parasitic element is in off-state, the direction of radiation of antenna may be indicated by the arrow as illustrated in FIG. 12D. The number of parasitic elements to cover a specific set of beam directions may be reduced by setting parasitic elements to a reflector or a director.

Parasitic elements 220/260 may give a negative effect on the antenna radiation efficiency. Also, parasitic elements 220/260 in one first/second antenna may interfere with the radiation patterns of other first/second antennas in antenna apparatus 100. Therefore, the radiation pattern of each antenna in the antenna apparatus 100 may be improved by reducing the number of parasitic elements. Also, the size of the antenna apparatus may be reduced by reducing the number of parasitic elements.

Figure 13:
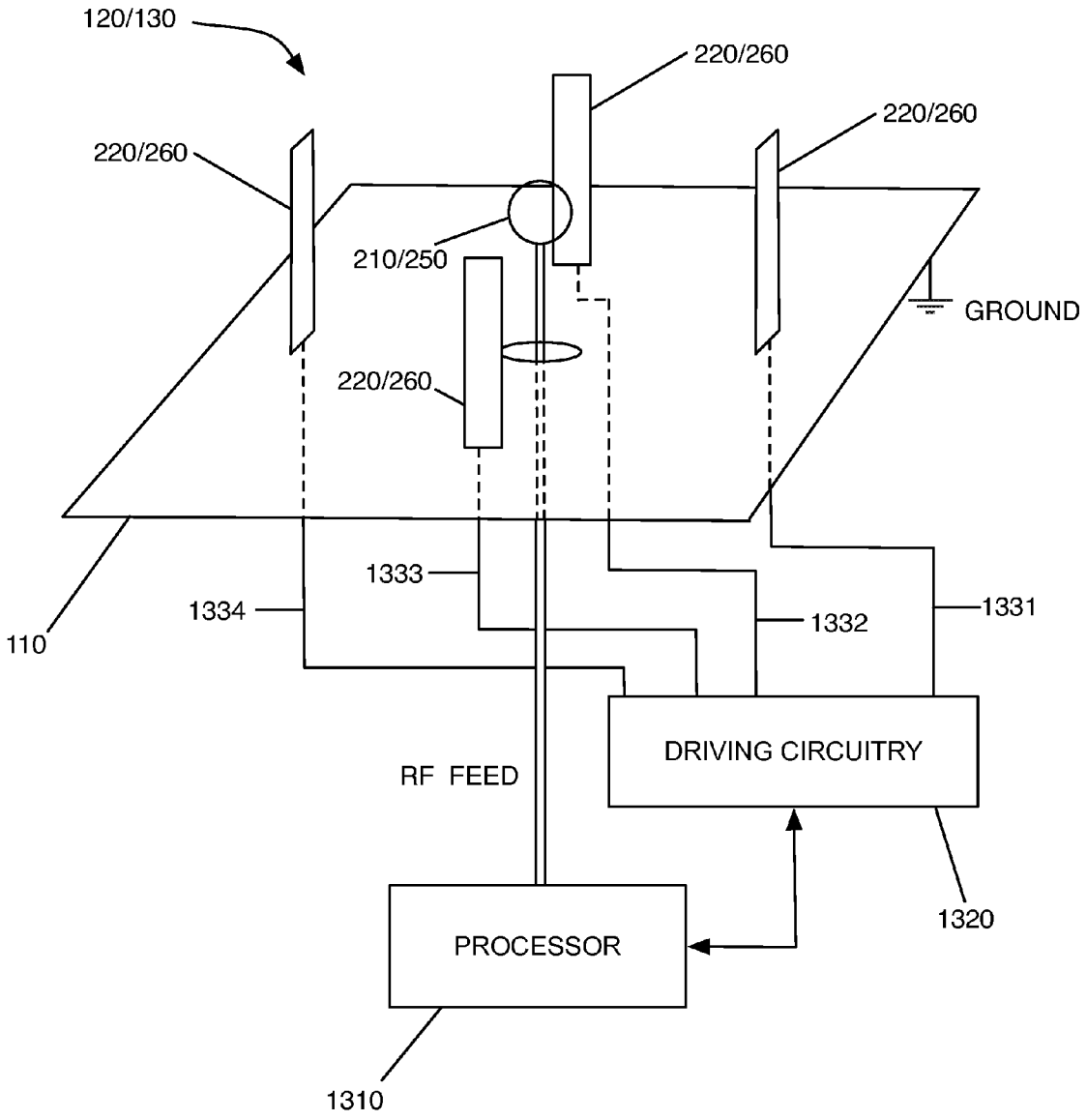
FIG. 13 is a schematic diagram of a DC bias network associated with an antenna in the antenna apparatus.

FIG. 13 is a schematic diagram of a DC bias network associated with the first/second antennas in the antenna apparatus. The DC bias network may include driving circuitry 1320 configured to convert a digital control signals to analog signals. Driving circuitry 1320 may be configured to provide, based on the analog signals, respective direct current (DC) biases to the first switching devices associated with first parasitic elements 220 in first antenna 120 and/or the second switching devices associated with second parasitic elements 260 in second antenna 130 via corresponding bias lines 1331-1334. Driving circuitry 1320 may be a programmable logic device. One driving circuitry 1320 may be associated with at least one of one or more first antenna 120 and one or more second antenna 130. Alternatively, a plurality of driving circuitries may be associated with one or more first antenna 120 and one or more second antenna 130, respectively.

The DC bias network may include processor 1310. Processor 1310 may be configured to generate the digital control signals, and provide the control signals to driving circuitry 1320. Processor 1310 may apply beam steering algorithms to control transforming behavior of antenna apparatus 100. For example, processor 1310 may generate the digital control signals to control transforming behavior of antenna apparatus 100 so that the throughput of antenna apparatus 100 associated with a wireless communication device (e.g. a WiFi access point) may be maximized and the spectral efficiency of the wireless network including the antenna apparatus 100 may be improved.

Antenna apparatus 100 may include at least a part of the DC bias network as illustrated in FIG. 13. At least a part of the DC bias network may be embedded on reflective layer 110. For example, while antenna apparatus 100 is disposed on a surface of reflective layer 110, at least a part of the DC bias network may be embedded on the rear surface of the reflective layer 110. Alternatively, at least a part of the DC bias network may be provided independently from antenna apparatus 100, and may be connected to one or more first antennas 120 and/or one or more second antennas 130 without being integrated with antenna apparatus 100.

Figure 14A:
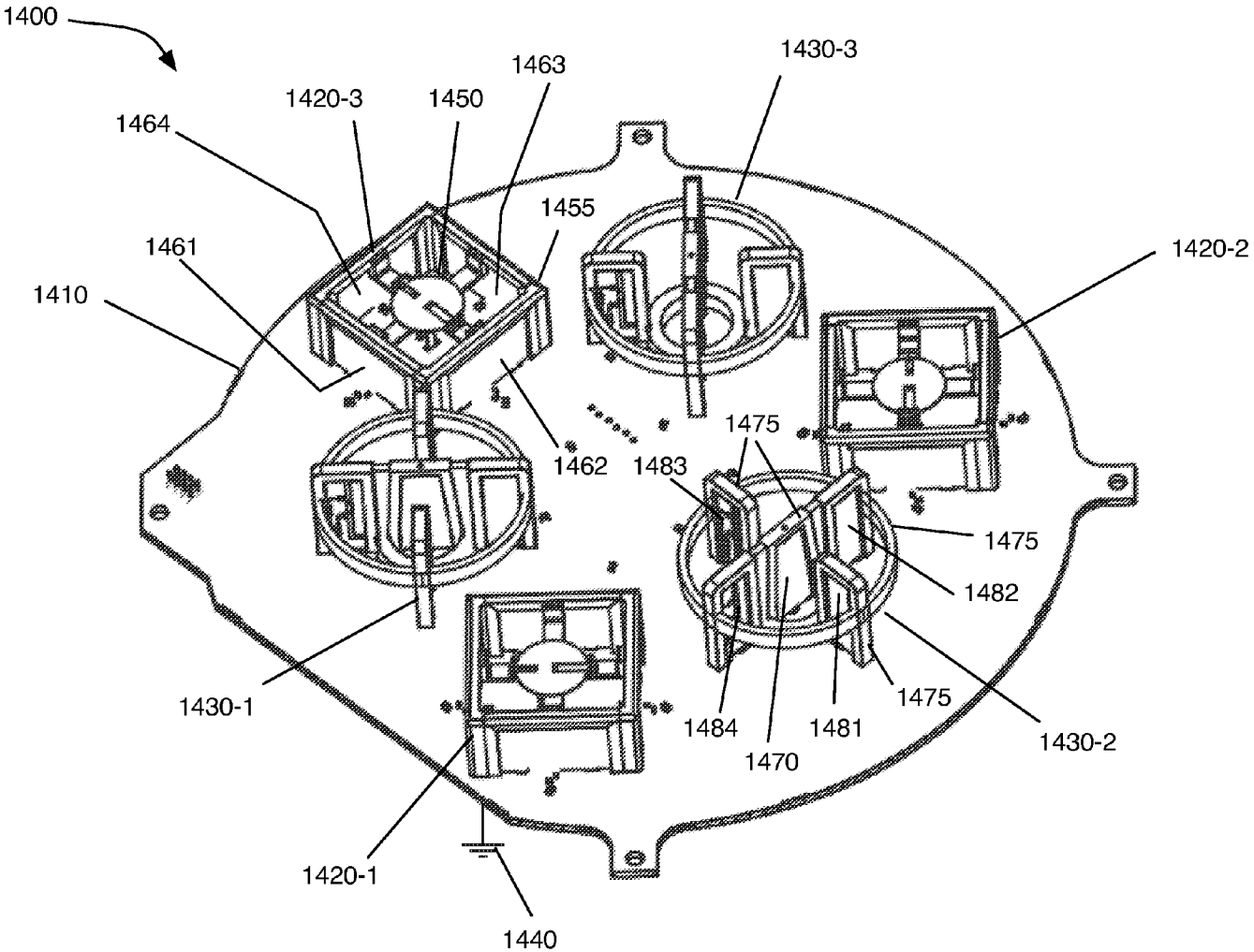
FIG. 14A is a perspective view of an exemplary reconfigurable antenna apparatus.
Figure 14B:
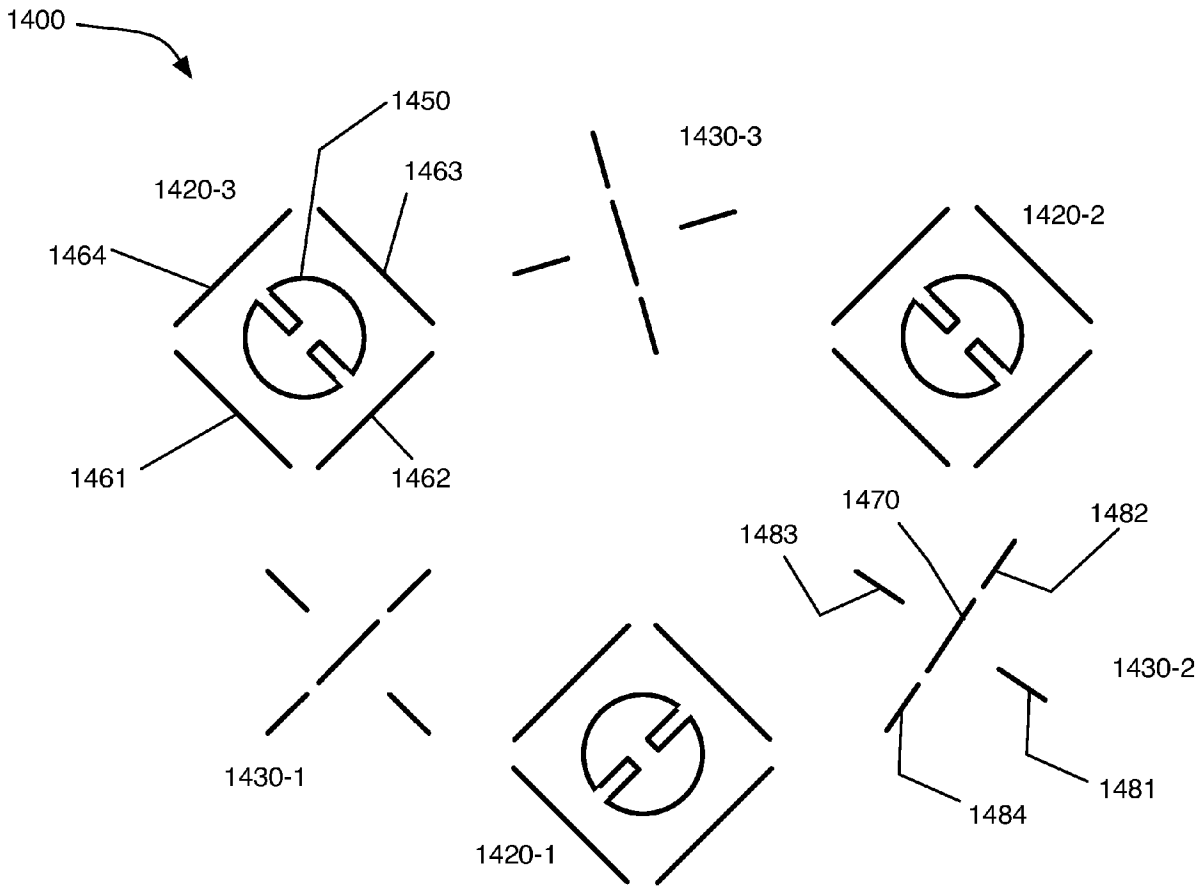
FIG. 14B is a top view of the first active elements, first parasitic elements, second active elements, and second parasitic elements in the reconfigurable antenna apparatus shown in FIG. 14A.

FIG. 14A is a perspective view of an exemplary reconfigurable antenna apparatus. FIG. 14B is a top view of the first active elements, first parasitic elements, second active elements, and second parasitic elements in the reconfigurable antenna apparatus shown in FIG. 14A. Antenna apparatus 1400 may include reflective layer 1410, first antennas 1420-1, 1420-2, 1420-3, and second antennas 1430-1, 1430-2, 1430-3.

First antennas 1420-1, 1420-2, 1420-3 may operate at a first frequency. Second antennas 1430-1, 1430-2, 1430-3 may operate at a second frequency. The first frequency may be different from the second frequency. For example, the first frequency may be approximately 2.4 GHz, and the second frequency may be approximately 5 G Hz. First antennas 1420-1, 1420-2, 1420-3 may cover 5-6 GHz WiFi band. Second antennas 1430-1, 1430-2, 1430-3 may cover 2.4-2.5 GHz WiFi band.

First antennas 1420-1, 1420-2, 1420-3 may be disposed on reflective layer 1410. Second antennas 1430-1, 1430-2, 1430-3 may be disposed on reflective layer 1410. First antennas 1420-1, 1420-2, 1420-3 and second antennas 1430-1, 1430-2, 1430-3 may be disposed on the same surface of reflective layer 1410. Reflective layer 1410 may be a PCB or dual layer PCB. The PCB and the dual layer PCB may include dielectric material. Reflective layer 1410 may connect to ground 1440. Reflective layer 1410 may be covered with copper, and may act as the ground layer effectively.

First antennas 1420-1, 1420-2, 1420-3 and second antennas 1430-1, 1430-2, 1430-3 may be disposed alternately, surrounding the center of reflective layer 1410. Defining the first distance to be a distance between a center of first active element 1450 in one of first antennas 1420-1, 1420-2, 1420-3 and a center of first active element 1450 in another of first antennas 1420-1, 1420-2, 1420-3 closest to the one of first antennas 1420-1, 1420-2, 1420-3, the first distance may be set at least $\lambda_1/2$. $\lambda_1$ is a wavelength of the first frequency. Defining the second distance to be a distance between a center of second active element 1470 in one of second antennas 1430-

1, 1430-2, and 1430-3 and a center of second active element 1470 in another of second antenna 1430-1, 1430-2, and 1430-3 closest to the one of second antennas 1430-1, 1430-2, 1430-3, the second distance between one of second antennas 1430-1, 1430-2, 1430-3 and another second antenna 130 closest to the one of second antennas 130 may be set at least $\lambda_2/2$. $\lambda_2$ is a wavelength of the second frequency.

In the antenna apparatus illustrated in FIG. 14, the number of first antennas 1420-1, 1420-2, 1420-3 is three, and the number of second antennas 1430-1, 1430-2, 1430-3 is three. However, the number of first antenna(s) included in antenna apparatus 1400 may be any integer equal to one or more. As well, the number of second antenna(s) included in antenna apparatus 1400 may be any integer equal to one or more. The number of one or more first antennas included in antenna apparatus 1400 may be the same as or different from the number of one or more second antennas included in antenna apparatus 1400.

Each of first antennas 1420-1, 1420-2, 1420-3 may include first active element 1450 and four first parasitic elements 1461, 1462, 1463, 1464. Four first parasitic elements 1461, 1462, 1463, 1464 may be spaced evenly in azimuth angle around active element 1450.

First active element 1450 and four first parasitic elements 1461, 1462, 1463, 1464 of each first antenna 1420-1, 1420-2, 1420-3 may be supported by first frame 1455. First frame 1455 may be made of non-metal material such as a plastic. The top of first frame 1455 may have a top part forming a square or rectangular opening. First frame 1455 may have four legs. Each of the four legs may be connected a corresponding one of four corners of the top part.

Each of second antennas 1430-1, 1430-2, 1430-3 may include second active element 1470 and four second parasitic elements 1481, 1482, 1483, 1484. Four second parasitic elements 1481, 1482, 1483, 1484 may be spaced evenly in azimuth angle around second active element 1470.

Second active element 1470 and four second parasitic elements 1481, 1482, 1483, 1484 of each second antenna 1430-1, 1430-2, 1430-3 may be supported by second frame 1475. Second frame 1475 may be made of non-metal material such as a plastic. Second frame 1475 may be disposed on reflective layer 1410. In second frame 1475, second active element 1470 may be disposed in a plane including the center of second frame 1475.

Second active element 1470 may be disposed substantially perpendicularly to reflective layer 1410. Also, in second frame 1475, parasitic elements 1481, 1482, 1483, 1484 may be disposed in a plane extending from the center of second frame 1475 to the outside of the second frame 1475. Second active element 1470 and two parasitic elements 1482, 1484 may be disposed on the same dielectric layer.

FIG. 15 is a perspective view of an exemplary first active element of the first antenna illustrated in FIG. 14. First active element 1450 may be of a monopole-type. First active element 1450 may include a metal plate 1500 having slits 1510, 1520. Metal plate 1500 may be of a circular shape. Each of slits 1510, 1520 may be provided from the periphery of metal plate 1500 toward the center of metal plate 1500. Metal plate 1500 may be disposed substantially at the center of first antenna 120. For example, metal plate 1500 may be disposed close to the square or rectangular opening of first frame 1455 as illustrated in FIG. 14. Metal plate 1500 may be disposed substantially in parallel to reflective layer 1410. First metal arm 1540 may be extended downward from one end of one of the slits 1520. Second metal arm 1550 may be extended downward from one end of another slit 1530. First metal arm 1540 may be connected to the ground. Second metal arm 1550 may include a RF feed point connected to a power supply. A RF electric power may be supplied via the RF feed point included in second arm 1550 from a power supply.

FIG. 16 is a perspective view of another exemplary first active element of the first antenna illustrated in FIG. 14. First active element 1600 may be a PIFA antenna. First active element 1600 may be made of metal. First active element 1600 may of F-shape from the side view. First active element 1600 may include plate portion 1610, third arm 1620 and a fourth arm 1630. Plate portion 1610 may be disposed substantially in parallel to reflective layer 1410. Third arm 1620 may be extended downward from plate portion 1610. Fourth arm 1630 may be extended downward from plate portion 1610. Third arm 1620 may be connected to the ground. Fourth arm 1630 may include a RF feed point connected to a power supply. A RF electric power may be supplied via the RF feed point included in fourth arm 1630 from a power supply.

Figure 17B:
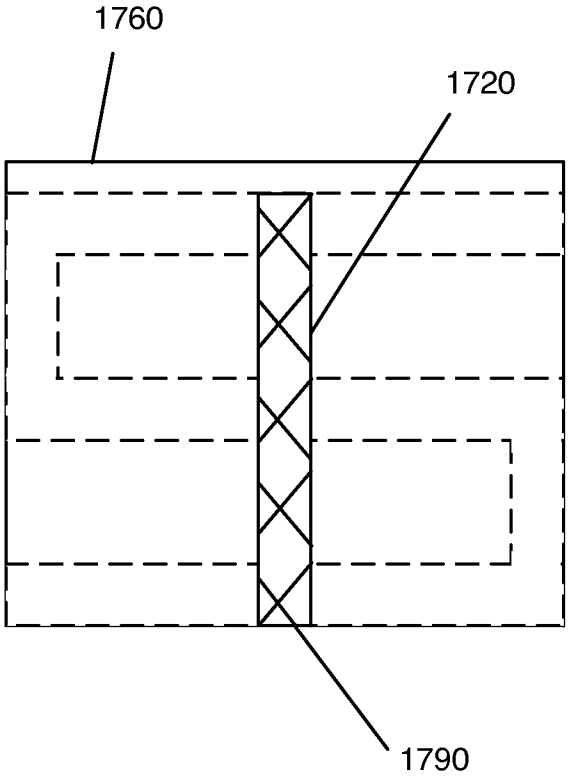
FIG. 17B is a second portion of the metamaterial inspired parasitic element as the first parasitic element of the first antenna illustrated in FIG. 14.
Figure 17A:
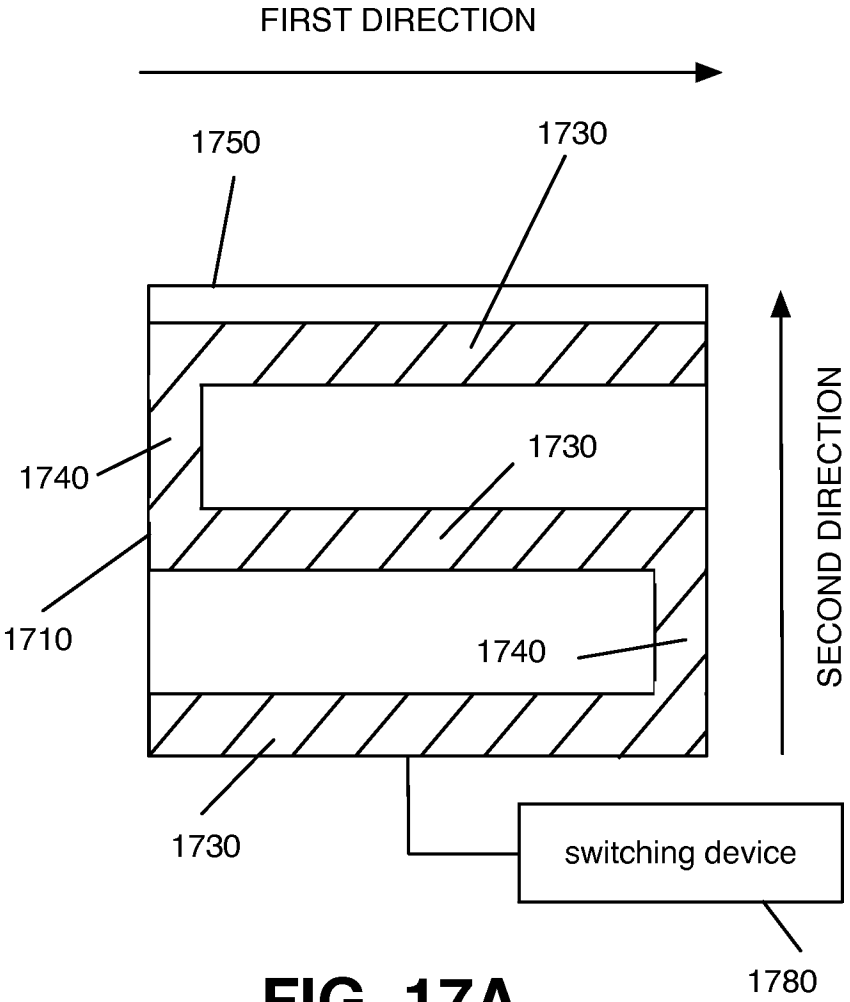
FIG. 17A is a first portion of a metamaterial inspired parasitic element as the first parasitic element of the first antenna illustrated in FIG. 14.

Metamaterial inspired parasitic elements may be implemented as first parasitic elements 1461, 1462, 1463, 1464. FIG. 17A is a first portion of an exemplary metamaterial inspired parasitic element as the first parasitic element of the first antenna illustrated in FIG. 14. FIG. 17B is a second portion of the exemplary metamaterial inspired parasitic element as the first parasitic element of the first antenna illustrated in FIG. 14.

Each first parasitic element 1461, 1462, 1463, 1464 may include first metal strip 1710 and second metal strip 1720.

First metal strip 1710 may be disposed on a first surface 1750 of a dielectric layer. Second metal strip 1720 may be disposed on second surface 1760 of the dielectric layer. The dielectric layer may not attach reflective layer 1410. Second surface 1760 may be a rear surface opposed to first surface 1750. First metal strip 1710 may have a meander shape. The meander shape may include a zigzag shape, a repeated S shape, or comb shape. Second metal strip 1720 may be a monopole-type segment. Over a specified frequency range, by including first metal strip 1710 having the meander shape in at least one of first parasitic elements 1461, 1462, 1463, 1464, epsilon-negative regions for propagating electromagnetic waves may be created. A current induced by the near-field of a monopole along a continuous path of the meander strip may create an inductive contribution so that reactance of the monopole may be neutralized. Therefore, first metal strip 1710 having the meander shape may act as an impedance transformer providing matching to a free space.

First metal strip 1710 having the meander shape may include M first segments 1730 in a first direction and N second segments 1740 in a second direction, respectively. Here, M may be an integer ≥2. N may be M−1. The first direction may be substantially parallel to reflective layer 1410. The second direction may be substantially perpendicular to reflective layer 1410. One end portion of ith first segment 1730 is connected to one end portion of (i+1)th first segment 1730 via ith second segment 1740, and the other end portion of the (i+1)th first segment 1730 is connected to one end portion of (i+2)th first segment 1730 via the (i+1)th second segment 1740, where $1 \leq i < M$.

Second metal strip 1720 may be perpendicular to reflective layer 1410. Or, second metal strip 1720 may be perpendicular to the first direction.

Antenna apparatus 100 may include first switching devices 1780. Each of first switching devices 1780 may be connected to corresponding one of first parasitic elements. For example, first switching device 1780 may be connected to first metal strip 1730. Lower end 1790 of second strip 1720 may be close to reflective layer 1410, but may not contact reflective layer 1410. Switching device 1780 may correspond to switching device 420 in FIG. 4, or switching device 520 in FIG. 5. At least one of the first switching devices 1780 associated with a corresponding one of first parasitic element 1461, 1462, 1463, 1464, an inductor(s), capacitor, and or a diode may have configuration as illustrated in FIGS. 4 and 5.

Figure 18:
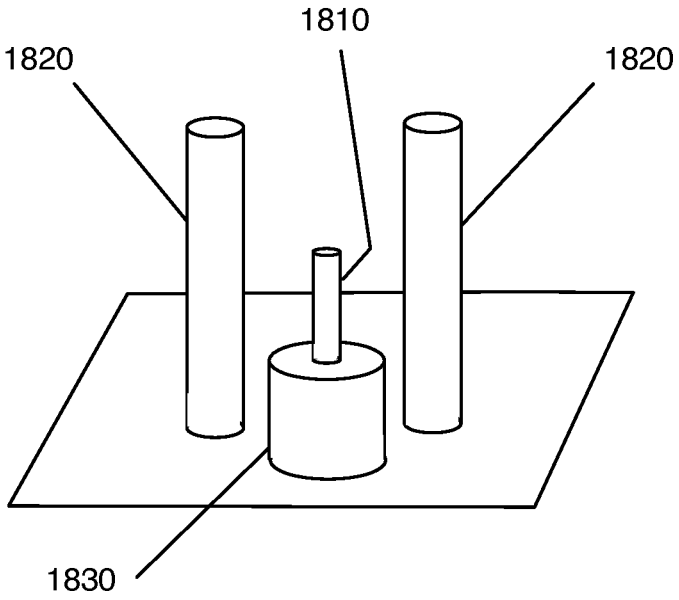
FIG. 18 is a perspective view of another exemplary metamaterial inspired parasitic element as the first parasitic element of the first antenna illustrated in FIG. 14.

FIG. 18 is a perspective view of another exemplary metamaterial inspired parasitic element as the first parasitic element of the first antenna illustrated in FIG. 14. Monopole-type parasitic element 1810 associated with near-field parasitic cylindrical inductors 1820 may be implemented as at least one of first parasitic elements 1461, 1462, 1463, 1464. The lower part of monopole-type parasitic element 1810 may be covered with coaxial electrical feed portion 1830.

The resonant behavior of the metamaterial inspired parasitic element as illustrated in FIGS. 17A and 17B may be varied according to at least one of the length of second metal strip 1720 which is monopole-type portion, a distance between one of first segments 1730 and the next first segment 1730, a length of first metal strip 1710, or dielectric permittivity.

For example, capacitance of the metamaterial inspired parasitic element may increase by reducing the length of monopole-type portion. Alternatively, a smaller inductance of the meander metal strip may be obtained by reducing the length of the meander metal strip.

Radiators having a resonance frequency $f_0$ may also resonate at frequencies, multiplied $f_0$. When a monopole-type radiator/active element and a dipole-type radiator/active element have a resonance frequency $f_0$, the monopole-type radiator/active element and the dipole-type radiator/active element may also resonate at frequencies, multiplied $f_0$. When antennas in close proximity resonate at $f_0$ or multiplied $f_0$, the antennas may interfere with each other. However, such interference may be minimized by controlling the resonance frequency of the antenna properly. The metamaterial inspired parasitic element as described above may resonate at the lowest resonant frequency $f_0$ and may not resonate in higher frequency bands (e.g. $2f_0$) of other antennas in the antenna apparatus. Therefore, undesired interference between the antennas in the antenna apparatus may be minimized. When metamaterial inspired parasitic element is not used as first parasitic element 1461, 1462, 1463, 1464, first parasitic elements 1461, 1462, 1463, 1464 may resonate in the higher frequency bands (e.g. multiplied $f_0$) of other antennas in the antenna apparatus, and may cause a significant distortion of the radiation pattern.

Figure 19:
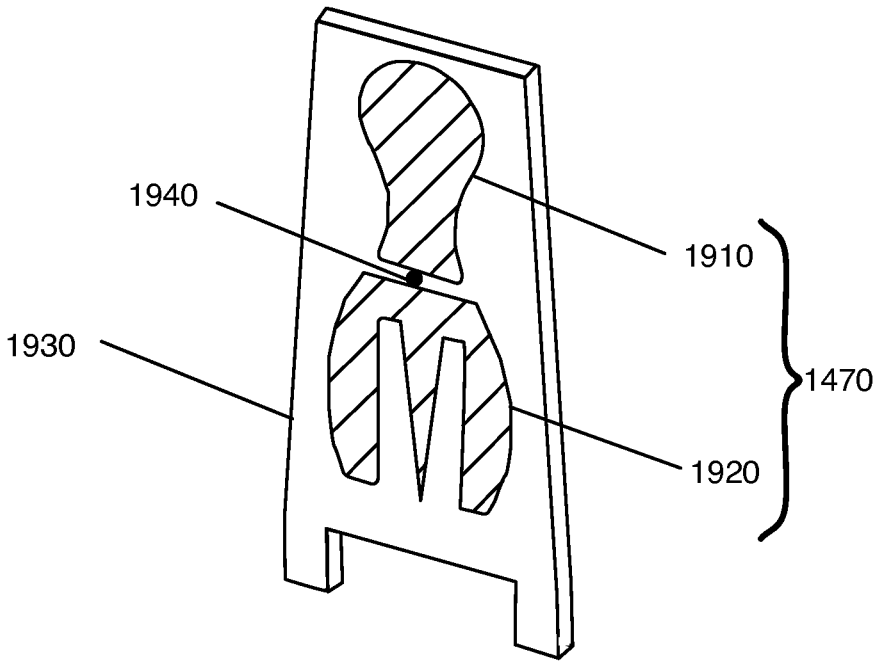
FIG. 19 is a perspective view of an exemplary second active element of the second antenna illustrated in FIG. 14.

FIG. 19 is a perspective view of an exemplary second active element of the second antenna illustrated in FIG. 14. Second active element 1470 may be dipole type. Second active element 1470 may include first metal segment 1910 and second metal segment 1920. First metal segment 1910 and Second metal segment 1920 may be disposed on dielectric layer 1930. Electrical power feed point 1940 may be disposed between first metal segment 1910 and second metal segment 1920.

Second parasitic elements 1481, 1482, 1483, 1484 may be a dipole-type. For example, at least one of second parasitic elements 1481, 1482, 1483, 1484 correspond to parasitic element 600 in FIG. 6, parasitic element 700 in FIG. 7, parasitic element 800 in FIG. 8, or parasitic element 900 in FIG. 9.

Antenna apparatus 1400 may include second switching devices. Each of the second switching devices may correspond to switching device 630 in FIG. 6, switching devices 740, 745 in FIG. 7, switching devices 840, 845 in FIG. 8, or switching device 930 in FIG. 9.

Figure 20B:
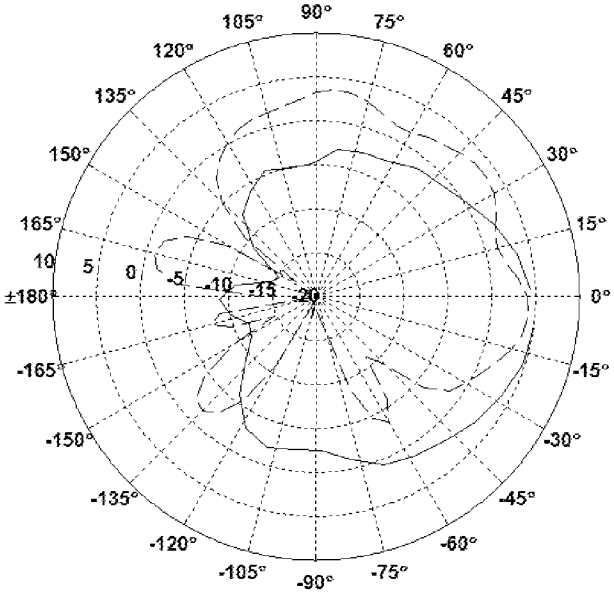
FIG. 20B is exemplary radiation patterns of the antenna apparatus in FIG. 14 in the directional mode.
Figure 20A:
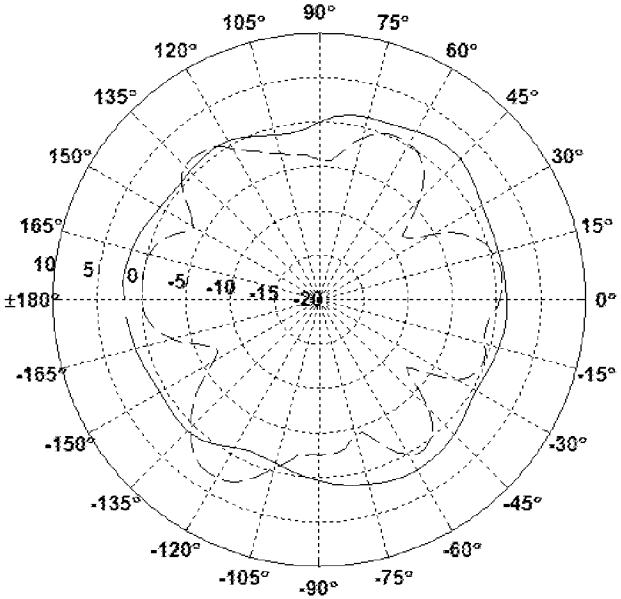
FIG. 20A is exemplary radiation patterns of the antenna apparatus in FIG. 14 in the omni-directional mode.

FIG. 20A is exemplary radiation patterns of second antenna in FIG. 14 in the omni-directional mode; and FIG. 20B is exemplary radiation patterns of one of the second antennas in FIG. 14 in the directional mode.

Where first parasitic elements 1461, 1462, 1463, 1464 in one of first antennas 1420-1, 1420-2, 1420-3 includes metamaterial inspired parasitic elements, one of second antennas 1430-1, 1430-2, 1430-3 may present a radiation pattern indicated by the solid line in FIG. 20A, in the omni-directional mode.

Where first parasitic elements 1461, 1462, 1463, 1464 in one of first antennas 1420-1, 1420-2, 1420-3 doe not include metamaterial inspired parasitic elements, one of second antennas 1430-1, 1430-2, 1430-3 may present a radiation pattern indicated by the dashed line in FIG. 20A, in the omni-directional mode.

On the other hand, where first parasitic elements 1461, 1462, 1463, 1464 in one of first antennas 1420-1, 1420-2, 1420-3 includes metamaterial inspired parasitic elements, one of second antennas 1430-1, 1430-2, 1430-3 may present a radiation pattern indicated by the solid line in FIG. 20B, in the directional mode.

Where first parasitic elements 1461, 1462, 1463, 1464 in one of first antennas 1420-1, 1420-2, 1420-3 doe not include metamaterial inspired parasitic elements, one of second antennas 1430-1, 1430-2, 1430-3 may present a radiation pattern indicated by the dashed line in FIG. 20B, in the directional mode.

The second frequency at which second antennas 1430-1, 1430-2, 1430-3 operate may be higher than first frequency at which first antennas 1420-1, 1420-2, 1420-3. The radiation pattern of second antennas 1430-1, 1430-2, 1430-3 may be disturbed less in the omni-directional mode and the directional mode when second antennas 1430-1, 1430-2, 1430-3 include metamaterial inspired parasitic elements as second parasitic elements.

Also, the height of antenna apparatus 1400 may be reduced by 40% when second antennas 1430-1, 1430-2, 1430-3 include metamaterial inspired parasitic elements as second parasitic elements.

CONCLUSION

The foregoing description of the embodiments described herein provides illustration and description, but is not intended to be exhaustive or to limit the implementations to the precise form disclosed. Modifications and variations are possible in light of the above teachings or may be acquired from the practice of the teachings.

The term "comprises/comprising," "include/including, "have/having" as used herein, specifies the presence of stated features, integers, steps or components but does not preclude the presence or addition of one or more other features, integers, steps, components, or groups thereof.

No element, act, or instruction used in the present application should be construed as critical or essential to the implementations described herein unless explicitly described as such. Also, as used herein, the article "a" is intended to include one or more items. Further, the phrase "based on" is intended to mean "based, at least in part, on" unless explicitly stated otherwise.

As used herein, the terms "coupled" and "connected" may mean the joining of two members directly or indirectly to one another. The terms "coupled" and "connected" may also mean electrical connection of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the term "and/or" refers to any one of the items, any combination of the items, or all of the items with which this term is associated.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

The dimensions of each elements/components/segments are not meant to limit the dimensions which they describe, as the various elements/components/segments may be oriented differently in various applications.

What is claimed is:

1. An antenna apparatus comprising:

a reflective layer connected to a ground;

one or more first antennas disposed on the reflective layer, wherein each of the one or more first antennas operates at a first frequency, and includes a first active element and one or more first parasitic elements;

one or more first switching devices, each associated with corresponding one of the one or more first parasitic elements in at least one of one or more first antennas;

one or more second antennas disposed on the reflective layer, wherein each of the one or more second antennas operates at a second frequency, and includes a second active element and one or more second parasitic elements; and one or more second switching devices, each associated with corresponding one of the one or more second parasitic elements in at least one of one or more second antennas, wherein the first frequency is different from the second frequency, and wherein at least one of the one or more first parasitic elements includes:

a first non-metal plate having a first surface and a second surface opposed to the first surface, and a first metal strip disposed on the first surface.

2. The antenna apparatus of claim 1, wherein the first active element is one of a first dipole-type antenna, a first monopole-type antenna, or first Planar Inverted F Antenna (PIFA), at least one of the one or more first parasitic elements is of a first monopole-type, a first dipole-type, or first metamaterial-inspired-type, the second active element is one of a second dipole-type antenna, a second monopole-type antenna, or second PIFA, and at least one of the one or more second parasitic elements is of a second monopole-type, a second dipole-type, or second metamaterial-inspired-type.

3. The antenna apparatus of claim 1, wherein at least one of the one or more first switching devices includes a first diode, and the first diodes is connected to the corresponding one of the one or more first parasitic elements.

4. The antenna apparatus of claim 3, further comprising one or more first inductors, wherein the first diode is connected, in series, to corresponding one of the one or more first inductors.

5. The antenna apparatus of claim 3, further comprising one or more second inductors, wherein each of the one or more second inductors is connected to the corresponding one of the one or more first parasitic elements and the reflective layer.

6. The antenna apparatus of claim 1, further comprising:

one or more first capacitors, wherein each of the one or more capacitors is connected to the corresponding one of the one or more first parasitic elements via the first switching device and is connected to the reflective layer.

7. The antenna apparatus of claim 1, wherein the first active element includes a metal plate having slits and the metal plate is disposed at an upper part of the first antenna.

8. The antenna apparatus of claim 1, wherein the at least one of the one or more first parasitic elements further includes:

a second metal strip having a straight shape disposed on the second surface.

9. The antenna apparatus of claim 1, wherein the first metal strip has a meander shape.

10. The antenna apparatus of claim 9, wherein the first metal strip has M first segments in a first direction and N second segments in a second direction, respectively, wherein M is an integer ≥2, and one end portion of ith first segment is connected to one end portion of (i+1)th first segment via ith second segment, and the other end portion of the (i+1)th first segment is connected to one end portion of (i+2)th first segment via the (i+1)th second segment, wherein $1 \leq i < M$.

11. The antenna apparatus of claim 1, further comprising:

a driving circuitry configured to convert digital control signals generated by a processor to analog signals, and provide, based on the analog signals, respective direct current (DC) biases to at least one of the one or more first switching devices and the one or more second switching devices via corresponding bias lines.

12. The antenna apparatus of claim 1, wherein a distance between a first active element of one of the first antennas and a first active element of a first antenna closest to the one of the first antennas is equal to or more than $\lambda_1/2$, and $\lambda_1$ is a wavelength of the first frequency.

13. The antenna apparatus of claim 1, wherein a distance between a second active element of one of the second antennas and a first active element of a second antenna closest to the one of the second antennas is equal to or more than $\lambda_2/2$, and $\lambda_2$ is a wavelength of the second frequency.

14. The antenna apparatus of claim 1, wherein the second active element and at least two second parasitic elements among the second parasitic elements are disposed on a dielectric layer.

15. An antenna apparatus of claim 1, comprising:

a reflective layer connected to a ground;

one or more first antennas disposed on the reflective layer, wherein each of the one or more first antennas operates at a first frequency, and includes a first active element and one or more first parasitic elements;

one or more first switching devices, each associated with corresponding one of the one or more first parasitic elements in at least one of one or more first antennas;

one or more second antennas disposed on the reflective layer, wherein each of the one or more second antennas operates at a second frequency, and includes a second active element and one or more second parasitic elements; and one or more second switching devices, each associated with corresponding one of the one or more second parasitic elements in at least one of one or more second antennas, wherein the first frequency is different from the second frequency, and wherein at least one of the one or more second parasitic elements includes a first metal element and a second metal element, and at least one of the one or more second switching devices is connected to the first metal element and to the second metal element in series.

16. The antenna apparatus of claim 15, wherein at least one of the second switching devices includes a second diode, the first metal element is connected to the second diode, and the second metal element is connected to the second diode.

17. The antenna apparatus of claim 15, further comprising:

a third inductor connecting to the first metal element and the reflective layer; and a fourth inductor connecting to the second metal element and the reflective layer.

18. The antenna apparatus of claim 15, wherein at least one of the one or more second switching devices includes a third diode and fourth diode, a cathode of the third diode is connected to the fourth diode, the first metal element is connected to the third diode, and the second metal element is connected to the fourth diode.

19. The antenna apparatus of claim 18, further comprising:

a fifth inductor connecting to the first metal element;

a sixth inductor connecting to the second metal element; and a seventh inductor connecting to the fourth diode and the reflective layer.

20. The antenna apparatus of claim 15, wherein at least one of the one or more second switching devices includes a variable capacitor.

21. An antenna apparatus comprising:

a reflective layer connected to a ground;

one or more first antennas disposed on the reflective layer, wherein each of the one or more first antennas operates at a first frequency, and includes a first active element and one or more first parasitic elements;

one or more first switching devices, each associated with corresponding one of the one or more first parasitic elements in at least one of one or more first antennas;

one or more second antennas disposed on the reflective layer, wherein each of the one or more second antennas operates at a second frequency, and includes a second active element and one or more second parasitic elements; and one or more second switching devices, each associated with corresponding one of the one or more second parasitic elements in at least one of one or more second antennas, wherein the first frequency is different from the second frequency, and wherein:

at least one of the one or more second parasitic elements includes a third metal element, a fourth metal element, and a fifth metal element, at least one of the one or more second switching devices includes a first switch and a second switch, the first switch is connected to the third metal element and the fourth metal element, and the second switch is connected to the fourth metal element and to the fifth metal element.

22. The antenna apparatus of claim 21, wherein the first switch is a fifth diode, and the second switch is a sixth diode.

* * * * *